US005701555A

United States Patent [19]

Masuda et al.

[11] Patent Number: 5,701,555

[45] Date of Patent: Dec. 23, 1997

[54] SERIAL ELECTROPHOTOGRAPHY APPARATUS AND FIXING TEMPERATURE CONTROL METHOD

[75] Inventors: Syuzo Masuda, Saijo; Ryouichi Iwama, Kawasaki, both of Japan

[73] Assignee: Fujitsu Limited, Kawasaki, Japan

[21] Appl. No.: 506,696

[22] Filed: Jul. 25, 1995

Related U.S. Application Data

[63] Continuation-in-part of Ser. No. 289,531, Aug. 12, 1994, Pat. No. 5,506,666.

[30] Foreign Application Priority Data

Aug. 18, 1994 [JP] Japan ..... 6-194442

[51] Int. Cl.[6] ..... G03G 15/20

[52] U.S. Cl. ..... 399/69; 399/67; 399/335

[58] Field of Search ..... 355/200, 202, 355/203, 204, 208, 210, 282, 285, 289, 290; 219/216; 118/60; 399/67, 69, 130, 320, 330, 335, 338

[56] References Cited

U.S. PATENT DOCUMENTS

| | | |
|---|---|---|
| 5,001,515 | 3/1991 | Nomura et al. . |
| 5,032,873 | 7/1991 | Nishikawa . |
| 5,459,503 | 10/1995 | Ishii . |
| 5,461,463 | 10/1995 | Iwama . |
| 5,467,177 | 11/1995 | Iwama et al. . |
| 5,488,452 | 1/1996 | Iwama . |
| 5,506,666 | 4/1996 | Masuda et al. . |

FOREIGN PATENT DOCUMENTS

| | | |
|---|---|---|
| 61-94771 | 5/1986 | Japan . |
| 61-152463 | 7/1986 | Japan . |
| 61-145649 | 9/1986 | Japan . |
| 7-72761 | 3/1995 | Japan . |

*Primary Examiner*—Sandra L. Brase

*Attorney, Agent, or Firm*—Armstrong, Westerman, Hattori, McLeland, & Naughton

[57] ABSTRACT

A conveying unit conveys a recording sheet. A carriage comprises a process unit for forming a latent image and developing it so as to produce a developed image on an image carrier having a rotation axis parallel to a direction along which the conveying unit conveys the recording sheet, and a fixing unit using a fixing member for fixing the developed image to the recording sheet after the developed image has been transferred to the recording sheet. A transfer unit transfers the developed image produced on the image carrier to the recording sheet. A moving unit moves the carriage on the transfer unit along a direction perpendicular to the direction along which the conveying unit conveys the recording sheet, the carriage thus repeating a go-and-return operation in which the carriage fixes a line of the developed image onto the recording sheet while moving and then returns to a predetermined position. A heating unit heats the fixing member to a predetermined temperature. A measuring unit measures the temperature of the fixing member. A heating control unit drives the heating unit so as to make the temperature of the fixing member be the predetermined temperature based on the temperature measured by the measuring unit, the driving being performed either when the carriage is located at the predetermined position or while the carriage is returning to the predetermined position after the go-and-return operations has been performed a predetermined number of times.

13 Claims, 20 Drawing Sheets

SERIAL ELECTROPHOTOGRAPHY APPARATUS AND FIXING TEMPERATURE CONTROL METHOD

CONTINUING DATA

This is a continuation-in-part application of earlier-filed application Ser. No. 08/289,531 filed on Aug. 12, 1994, now issued as U.S. Pat. No. 5,506,666 on Apr. 9, 1996.

BACKGROUND OF THE INVENTION

1. Field of the Invention

The present invention relates to a serial electrophotography apparatus for printing images on recording sheets through an electrophotography process, and a fixing temperature control method therein.

Recently, serial electrophotography printers have been developed to meet a demand for low-cost, miniaturized electrophotography apparatuses. In such serial electrophotography printers, in general, image transfer is performed by moving, in a transfer device, a carriage on a conveyed recording sheet along a direction perpendicular to a conveying direction. Then, the transferred image is fixed by a fixing device disposed in the conveying direction.

2. Related Art

With reference to FIGS. 1A, 1B, a structure of a serial electrophotographic printer in the related art will be described.

The serial electrophotographic printer 11 shown in FIG. 1A is disclosed in Japanese Laid-Open Patent Application No. 56-152463. This printer is provided with a shaft 14 in parallel with conveying rollers 13*a*, 13*b* for conveying recording sheets 12. A carriage 15 is provided so that the carriage 15 may move, driven by a driving motor (not shown in the figures), along a direction perpendicular to the direction along which the recording sheets are conveyed, as being guided by the shaft 14.

Ahead along the conveying direction, a fixing device 16 having a fixing roller longer than a width of each recording sheet 12 is disposed. Further, a transfer device 17 is disposed below the recording sheet 12 along the carriage moving direction.

An image carrier 21 is mounted on the carriage 15 and is rotated at a circumferential speed corresponding to the carriage movement speed. A charger 22 uniformly charges a surface of the image carrier 21 and then an electrostatic latent image is formed thereon through an exposing device 23. The electrostatic latent image is converted into a visible toner image through a developing roller 26 with toner 25 prepared in a developer 24.

The toner image formed on the carrier 21 is transferred to the recording sheet 12 through the transfer device 17 which faces the image carrier 21 via the recording sheet 12. The toner image transferred on the recording sheet 12 is fixed by the fixing device 16 after being conveyed thereto.

Such a serial electrophotographic printer as the printer 11 may have problems that, if the fixing in the fixing device is performed in a non-contact manner, an energy density for fixing the toner may not be sufficiently high. As a result, the toner fixing may not be adequately performed. Further, a process speed may not be sufficiently high.

In order to eliminate such problems, there is a printer which is provided with a fixing roller in the carriage.

With reference to FIG. 2, a carriage having a fixing device 27 therein, which is provided with the fixing roller 28, will now be described. A structure of the carriage 15 shown in FIG. 2 is disclosed in Japanese Utility-Model Laid-Open Application No. 61-145649. A cleaner 30 shown in the figure removes the residual toner from the image carrier 21 after the printing operation.

The fixing roller 28 is rotated along a direction along which the image carrier 21 is rotated. Further, a heat source 29 acting as heating means such as a halogen lamp or the like is provided in the fixing roller 28. The fixing roller 28 is previously heated by the heat source 29 before the printing operation to a predetermined temperature. The temperature of the fixing roller 28 is measured by a temperature sensor (not shown in the figure) and thus is appropriately controlled. The fixing device 27 is moved together with the image carrier 21 and thus fixes the toner image on the recording sheet immediately after being transferred thereto from the image carrier 21.

Because the transfer performed through the transfer device 17 is performed using a predetermined voltage applied between the device 17 and the image carrier 21, an electrical conductive member such as an electrical conductive rubber is formed on a substrate in the transfer device 17.

Because the heat source 29 previously heats the fixing roller 28, if the fixing roller 28 comes into contact with the recording (paper) sheet 12, a fire may dangerously break out therefrom. Further, the previously heated fixing roller may be disadvantageously cooled by the recording sheet 12.

There is a known method in which a heat source is provided outside the fixing roller 28 and heats the fixing roller in a non-contact manner. However, in such a method, the fixing roller may not be sufficiently heated and a significant time is required to sufficiently heat the fixing roller in an initial heating or a re-heating after the fixing roller has been cooled. Thus, it is difficult to achieve high-speed printing.

With reference to FIGS. 3A and 3B, temperature variation on the fixing roller will now be described. In this case, the fixing speed is 100 millimeters/second and a temperature range within which the fixing can be appropriately performed is 180° C. through 210° C.

As shown in the figures, the temperature drops when the fixing is performed after the initial heating (to 210° C.). Further, the temperature drops when the carriage 15 returns to a home position (printing starting position) after finishing the printing operation. Then heating is performed preparatory to a subsequent printing operation. Such a temperature drop and a heating operation are repeated for each fixing operation.

As shown in FIG. 3B, the surface temperature of the fixing roller 28 may drop to be below 180° C. during the fixing. As a result, an appropriate fixing may not be performed and further a time is required for heating the fixing roller 28 to be in a temperature in the range between 180° C. and 210° C. Thus, high-speed printing cannot be achieved.

Further, the present inventors and others proposed in Japanese Patent Application No. 5-217609 a method in a serial electrophotographic printer. In the method, the fixing device being mounted in the carriage, the fixing roller rolls together with a recording drum and thus the toner images are fixed. For safety, an induction heating coil disposed outside the fixing roller heats the fixing roller in a non-contact manner.

In such a method, it is necessary to take special measures for preventing the fixing from being inadequately performed due to inadequate temperature of the fixing roller. Further, it is necessary to take special measures for preventing a printing speed from dropping and thus for achieving high-speed printing.

SUMMARY OF THE INVENTION

An object of the present invention is to provide a serial electrophotography apparatus and fixing temperature control method therein, in which printing quality can be improved and high-speed printing can be achieved.

A serial electrophotography apparatus according to the present invention comprises:

conveying means for conveying a recording sheet;

a carriage comprising process means for forming a latent image and developing it so as to produce a developed image on an image carrier having a rotation axis parallel to a direction along which said conveying means conveys said recording sheet, and fixing means using a fixing member for fixing said developed image to said recording sheet after said developed image has been transferred to said recording sheet;

transfer means for transferring said developed image produced on said image carrier to said recording sheet;

moving means for moving said carriage on said transfer means along a direction perpendicular to said direction along which said conveying means conveys said recording sheet, said carriage thus repeating a go-and-return operation in which said carriage fixes a line of said developed image onto said recording sheet while moving and then returns to a predetermined position;

heating means for heating said fixing member to a predetermined temperature;

measuring means for measuring a temperature of said fixing member; and heating control means for driving said heating means so as to make the temperature of said fixing member be said predetermined temperature based on the temperature measured by said measuring means, the driving being performed either when said carriage is located at said predetermined position or while said carriage is returning to said predetermined position after said go-and-return operation has been performed a predetermined number of times.

It is preferable that said heating means is provided either at a position to which said fixing member is in proximity when the carriage is located at said predetermined position or inside said fixing means.

It is also preferable that said moving means moves said carriage so that said carriage is located at said predetermined position during at least one of a time during which data to be printed out through said apparatus is being transferred to said apparatus externally and a time during which the recording sheet is being replaced.

In the apparatus, the developed image produced by the process means is transferred to the recording sheet as the carriage is moved in the direction perpendicular to the sheet conveying direction. Then, the fixing member at the predetermined temperature is used to fix the transferred image to the recording sheet. The heating of the fixing member is performed each time the predetermined number of times of the go-and-return operation of the carriage are performed and/or each time the go-and-return operation is repeated so as to perform printing for the recording sheet. The heating operation may be performed while the data to be printed out is being transferred to the apparatus externally. The heating operation may be performed when the carriage is located at the predetermined position or while the carriage is returning to the predetermined position.

As a result, printing quality degradation such as toner density unevenness appearing in a toner image fixed onto the recording sheet caused due to inadequate temperature of the fixing member can be prevented. If the heating is performed while the data is being transferred externally, a waiting time due to the data transfer can be effectively used for the heating operation and thus high-speed printing can be achieved.

It is preferable that:

said heating control means has a first set temperature for fixing said developed image onto said recording sheet and a second set temperature to which said fixing member is initially heated; and said heating control means drives said heating means when the temperature of said fixing member is in proximity to said first set temperature.

Further, it is preferable that:

said heating control means further has third set temperatures for predetermined numbers of times of said go-and-return operation performed after said heating means heats said fixing member; and said heating control means drives said heating means, when the temperature of said fixing member is below a relevant one of said third set temperatures after a number of said predetermined numbers of times of said go-and-return operation have been performed after said heating means heats said fixing member.

In the apparatus, the current temperature of the fixing member is checked appropriately with respect to either the first set temperature or the third set temperatures during the printing for the recording sheet, and the heating operation is performed if it is necessary according to the result of the checking. As a result, a necessary fixing temperature of the fixing member can be maintained. Since inadequate fixing i prevented, printing quality is improved.

It is preferable that said heating control means drives said heating means so as to heat said fixing member to a temperature not higher than said second set temperature each time a predetermined number of times of said go-and-return operation are performed.

Further, it is preferable that said heating control means drives said heating means so as to heat said fixing member, before said go-and-return operation for printing the last line for said recording sheet, so that the temperature of said fixing member may decrease to approximate a temperature, which is the lowest temperature required for performing an appropriate fixing operation, from starting to finishing said printing of said last line.

In the apparatus, the fixing member is heated each time a predetermined number of times of the go-and-return operation of the carriage have been performed to a temperature not higher than the second set temperature, or the heating is performed so that the temperature of the fixing member may become the lowest allowable temperature at a time of finishing the printing of the recording sheet. Thus, the heating amount is controlled appropriately so as to reduce a time required for the heating operation performed during the printing for the recording sheet. As a result, high-speed printing can be achieved.

Further, the heating during the printing for the recording sheet is performed so that the temperature of the fixing member may become the lowest allowable temperature from at a time of finishing the printing of the recording sheet, and a time required for returning the carriage and replacing the recording sheet can be effectively used for the heating operation. As a result, high-speed printing can be achieved.

It is preferable that said heating control means drives said heating means so as to heat said fixing member to a temperature such that the temperature of said fixing member may decrease to approximate a temperature, which is the lowest temperature required for performing an appropriate fixing operation, from starting to finishing printing of one recording sheet.

Further, it is preferable that said heating control means drives said heating means so as to heat said fixing member while said recording sheet is being replaced.

In the apparatus, the heating before starting the printing for the recording sheet is performed so that the temperature of the fixing member may decrease to be the lowest allowable temperature from starting to finishing the printing of the recording sheet. Further, a time required for returning the carriage and replacing the recording sheet is effectively used for the heating operation. As a result, high-speed printing can be achieved.

A fixing temperature control method for a serial electrophotography apparatus, according to the present invention, comprises a carriage comprising process means for forming a latent image and developing it so as to produce a developed image on an image carrier having a rotation axis parallel to a direction along which said conveying means conveys said recording sheet, and fixing means using a fixing member at a predetermined temperature for fixing said developed image to said recording sheet after said developed image has been transferred to said recording sheet.

Said carriage is moved on said transfer means along a direction perpendicular to said direction along which said recording sheet is conveyed, carriage thus repeating a go-and-return operation in which said carriage fixes a line of said developed image onto said recording sheet while moving and the returns to a predetermined position.

Said method comprises steps of:

a) determining an initial set temperature such that the temperature of said fixing member initially heated to said initial set temperature may not drop to a lowest allowable temperature, which is the lowest temperature required for performing an appropriate fixing operation, when said go-and-return fixing operation is performed at least once by said carriage;

b) heating said fixing member to said initial set temperature before printing for said recording sheet is started; and c) heating said fixing member to a temperature not higher than said initial set temperature each time a predetermined number of times of said go-and-return operation have been performed by said carriage.

In the method comprising the steps a), b) and c), printing quality degradation such as toner density unevenness appearing in a toner image fixed onto the recording sheet caused due to inadequate temperature of the fixing member can be prevented.

It is preferable that said step c) heats said fixing member so that the temperature of said fixing member may decrease to be said lowest allowable temperature from starting to finishing printing of one page of said recording sheet. In the method, the heating amount is controlled appropriately so as to reduce a time required for the heating operation performed during the printing for the recording sheet. As a result, high-speed printing can be achieved. Further, the heating during the printing for the recording sheet is performed so that the temperature of the fixing member may decrease to be the lowest allowable temperature from starting to finishing the printing of one page of the recording sheet, and a time required for returning the carriage and replacing the recording sheet can be effectively used for the heating operation. As a result, high-speed printing can be achieved.

Further, printing quality degradation such as toner density unevenness appearing in a toner image fixed onto the recording sheet caused due to inadequate temperature of the fixing member can be prevented.

Another fixing temperature control method for a serial electrophotography apparatus, according to the present invention, comprises a carriage comprising process means for forming a latent image and developing it so as to produce a developed image on an image carrier having a rotation axis parallel to a direction along which said conveying means conveys said recording sheet, and fixing means using a fixing member at a predetermined temperature for fixing said developed image to said recording sheet after said developed image has been transferred to said recording sheet.

Said carriage is moved on said transfer means along a direction perpendicular to said direction along which said recording sheet is conveyed, said carriage thus repeating a go-and-return operation in which said carriage fixes a line of said developed image onto said recording sheet while moving and then returns to a predetermined position.

Said method comprises steps of:

a) determining an initial set temperature such that the temperature of said fixing member initially heated to said initial set temperature may not drop to a temperature, which is the lowest temperature required for performing an appropriate fixing operation, when said go-and-return fixing operation is repeated by said carriage so as to perform printing for said recording sheet;

b) heating said fixing member to said initial set temperature before printing for said recording sheet is started; and c) heating said fixing member to a said initial set temperature after said go-and-return operation has been performed for the last line for said recording sheet.

In the method, the initial set temperature to which the fixing member is heated before starting the printing for the recording sheet is determined such that the temperature of the fixing member may decrease to be the lowest allowable temperature from starting to finishing the printing of the recording sheet. Then, a time required for returning the carriage and replacing the recording sheet can be effectively used for the heating operation. As a result, high-speed printing can be achieved.

Other objects and further features of the present invention will become more apparent from the following detailed description when read in conjunction with the accompanying drawings.

DESCRIPTION OF THE PREFERRED EMBODIMENTS

Figure 1A:
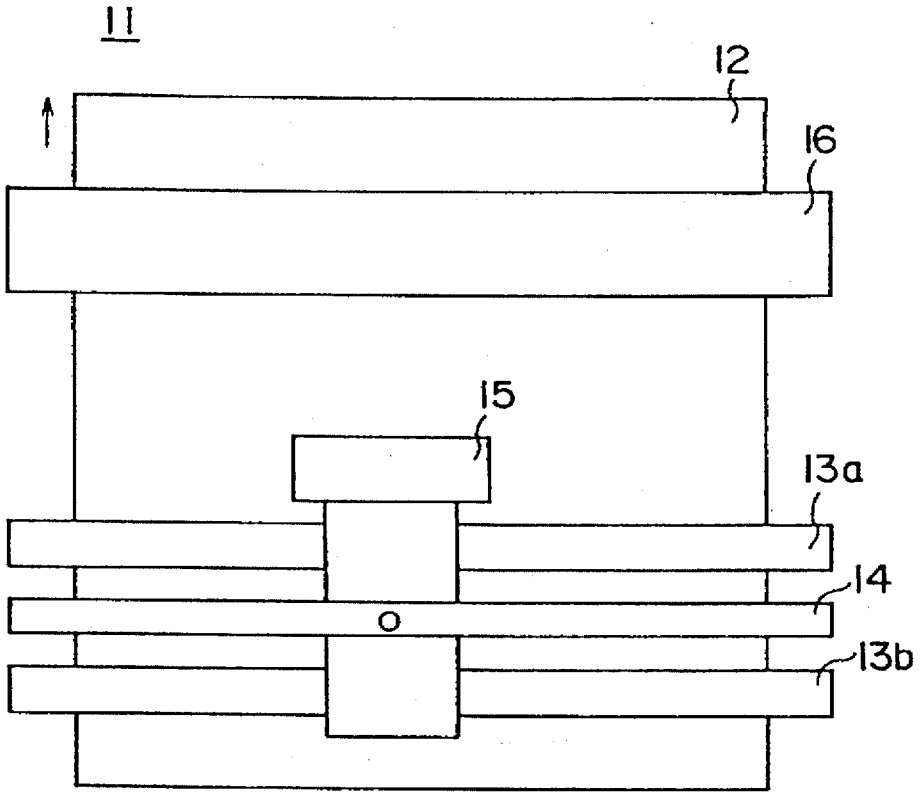
FIG. 1A PRIOR ART
FIGS. 1A and 1B show a plan view of a serial electrophotographic printer in the prior art and an elevational sectional view of a carriage of the printer.
Figure 1B:
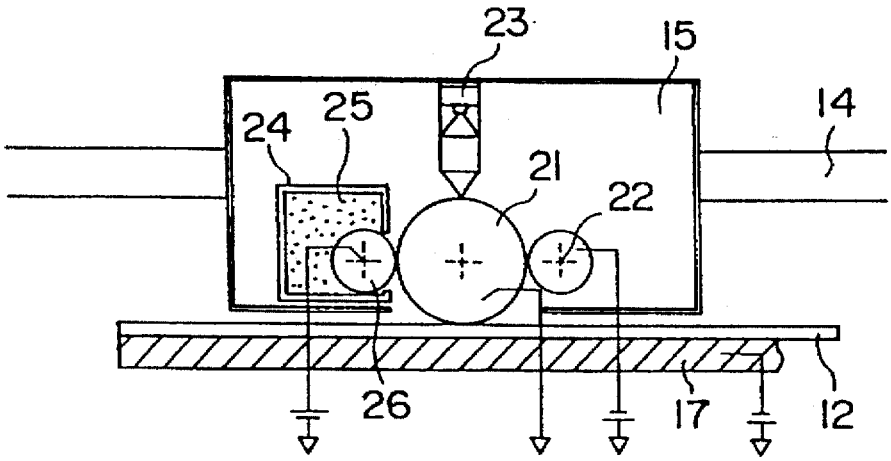
FIG. 1B PRIOR ART
Figure 2:
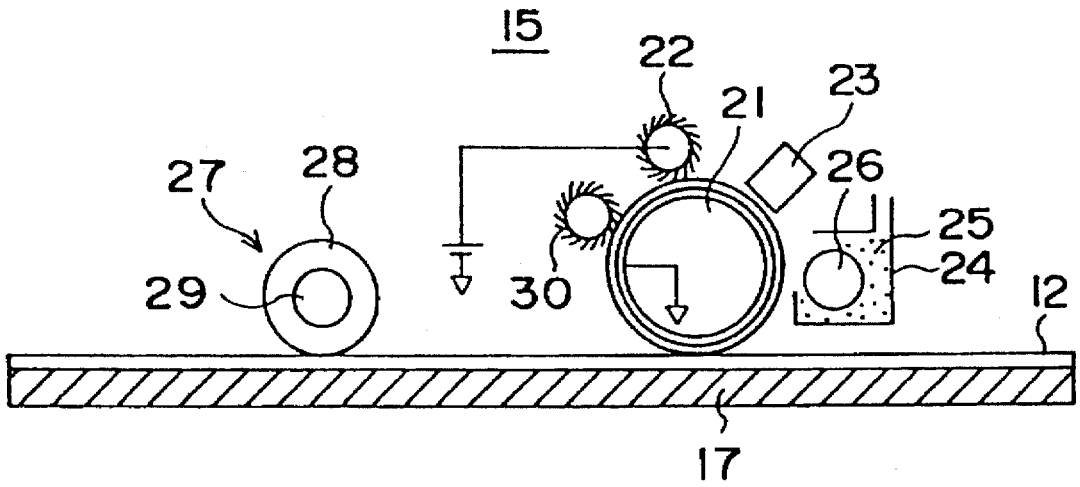
FIG. 2 PRIOR ART
FIG. 2 shows an arrangement of a carriage in the prior art.
Figure 3A:
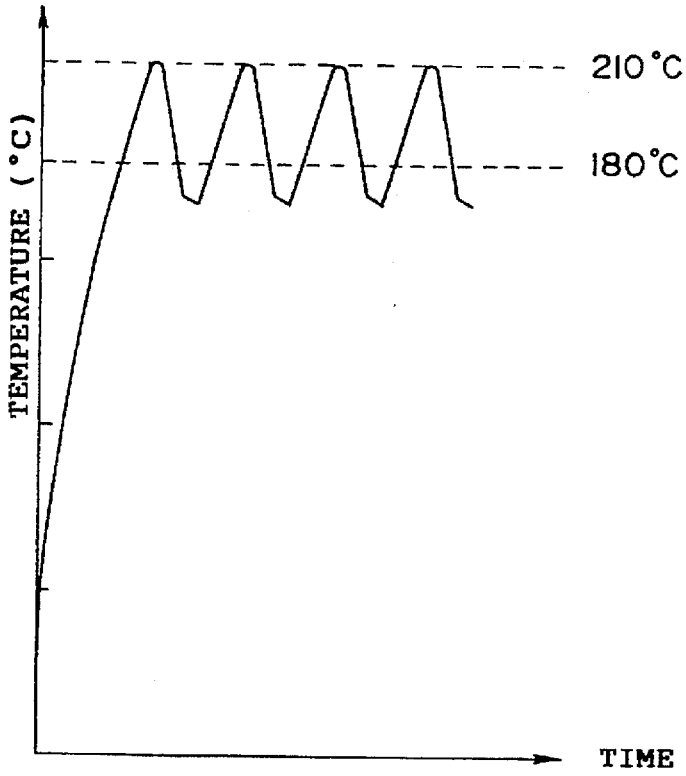
FIGS. 3A and 3B show graphs of fixing roller temperature variation in the related art.
Figure 3B:
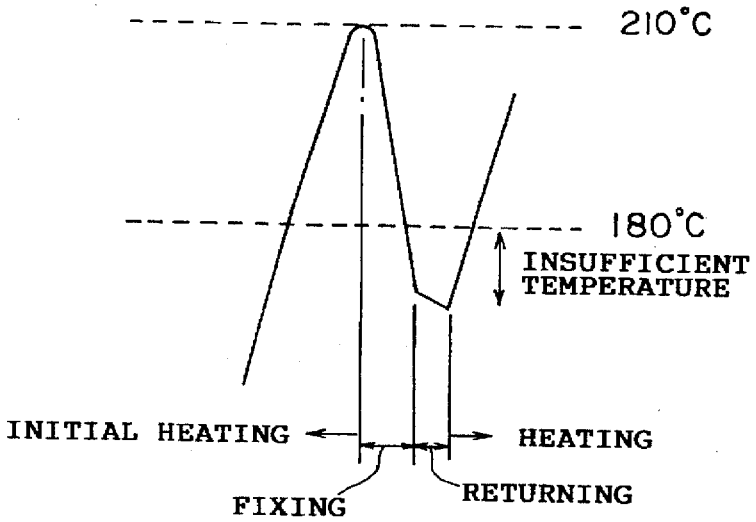
Figure 4A:
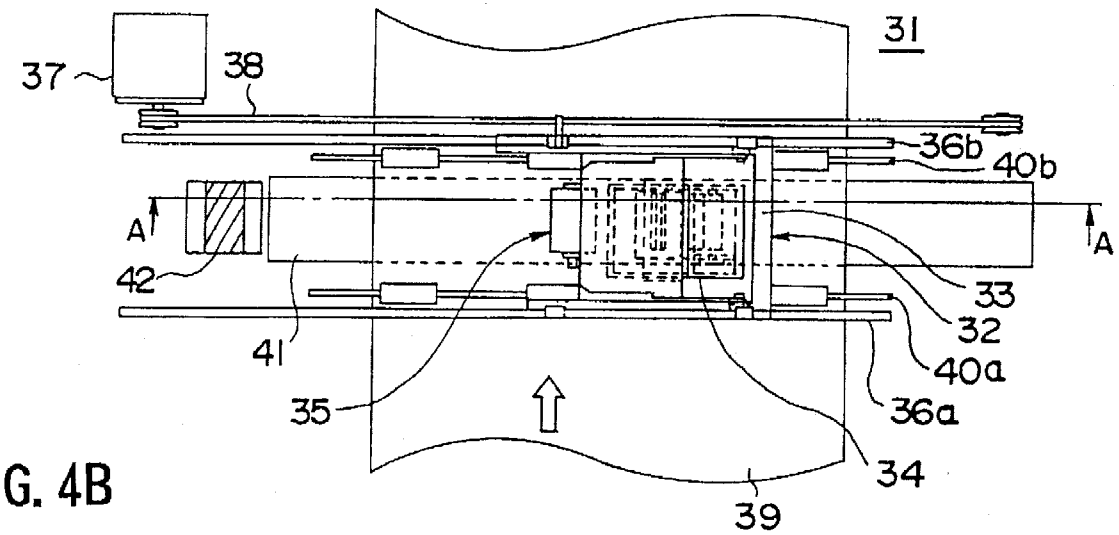
FIGS. 4A and 4B show a plan view of a serial electrophotographic printer in a first embodiment of the present invention, and an elevational sectional view of the printer taken along a line A—A.
Figure 4B:
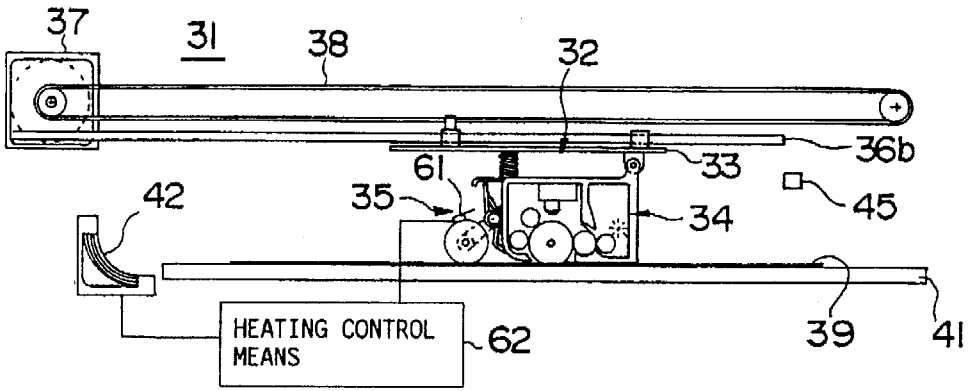
Figure 5:
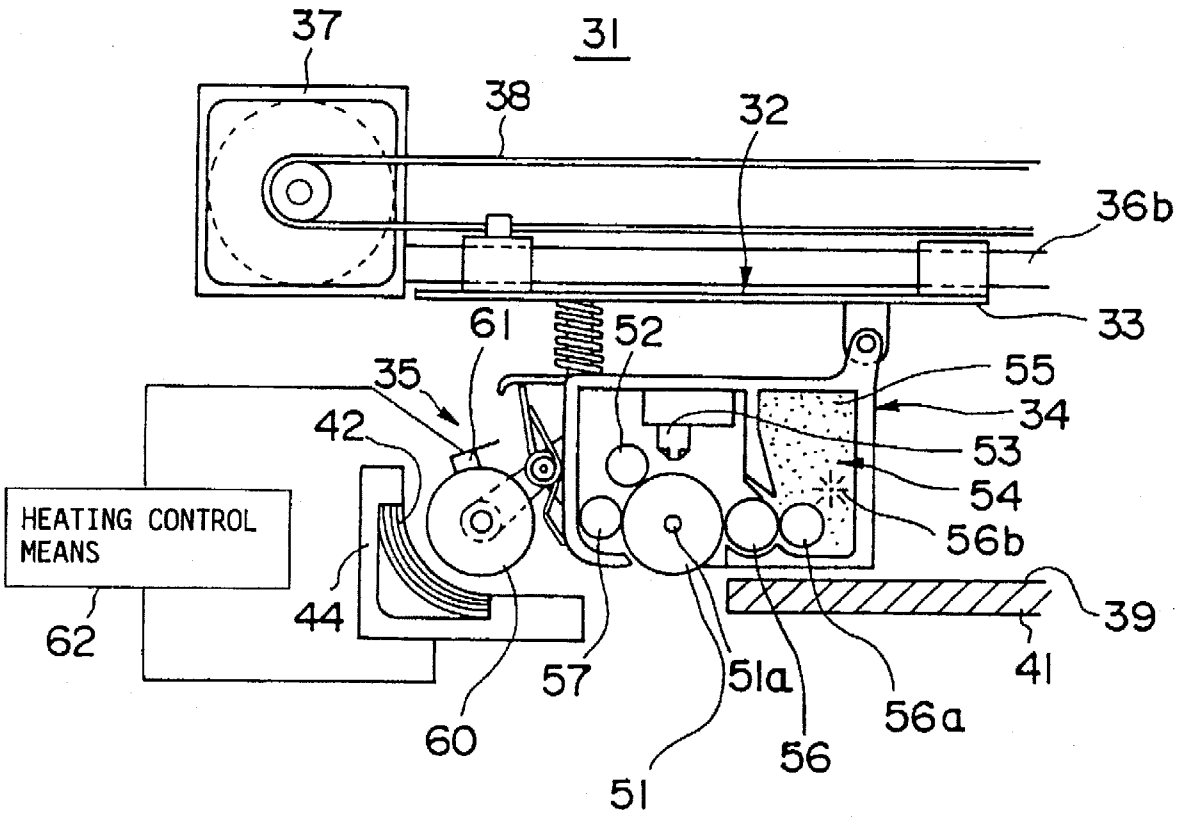
FIG. 5 shows a partial magnified view of the printer shown in FIG. 4A for illustrating a carriage and a heating portion.

With reference to FIGS. 4A, 4B and 5, a serial electrophotographic printer 31 in a first embodiment of a serial electrophotography apparatus according to the present invention will be described.

In a carriage 32, a process portion 34 acting as process means and a fixing portion 35 acting as fixing means are mounted to a sliding portion 33. The sliding portion 33 is guided by guide shafts 36*a* and 36*b* and is moved a carrier motor 37, acting as moving means, via a belt 38 along a direction perpendicular to a direction along which a recording sheet 39 is conveyed. The recording sheet 39 is conveyed along a direction according to an arrow shown in FIG. 4A by rotating shafts 40*a*, 40*b* (a driving motor is omitted in the figure) acting as conveying means.

A transfer device (transfer platen) 41 acting as transfer means is disposed below the carriage 32 along the carriage 32 moving direction.

The transfer device 41 is made as a result of a heat-resistant electrically conductive member (such as, for example, a silicon rubber in which an electrically conductive material is mixed) being formed on a carriage side of a substrate made of, for example, aluminum. The recording sheet is sandwiched between the transfer device 41 and the carriage 32 and is conveyed.

Further, as shown in FIG. 5, a recording drum 51 acting as an image carrier is provided in the process portion 34 in the carriage 32, and has a rotation axis 51*a* parallel to the recording sheet 39 conveying direction. The recording drum 51 is rotated at a circumferential speed corresponding to the carriage 32 moving speed on the recording sheet 41.

A charger 52 uniformly changes a surface of the recording drum 51 and then an electrostatic latent image is formed thereon through an exposing device (LED) 53. The electrostatic latent image is converted into a visible toner image through a developing roller 56 with toner 55 prepared in a developer 54 acting as developing means.

The toner image formed on the recording drum 51 is transferred to the recording sheet 39 through the transfer device 41 which faces the recording drum 51 via the recording sheet 39. The toner image transferred on the recording sheet 39 is fixed as a result of a predetermined voltage being applied between the recording drum 51 and the transfer device 41. The developing roller 56 is rotated at a circumferential speed higher, by a predetermined rate, than a circumferential speed of the recording drum 51.

The developer 54 is provided with a supply roller 56*a* coming into contact with the developing roller 56 for supplying the toner, and a paddle 56*b* for stirring the toner. Further, a cleaner 57 is provided for removing unnecessary residual toner from the recording drum 51.

Further, the fixing portion 35 mounted in the carriage 32 together with the process portion 34 is provided with a fixing roller 60. The fixing roller 60 is made from a magnetic member such as iron and has a protecting member coated on a surface thereon. A thermistor 61 acting as temperature measuring means is provided on the surface of the fixing roller 60.

An arc-shaped induction coil 42 acting as heating means is provided, in a holding body 44, along the fixing roller 60 as shown in FIG. 5. The providing position is such that the induction coil 42 is located in proximity to the fixing roller 60 in the fixing portion 35 when the carriage 32 is located at an initial position (home position) for starting printing.

The induction coil 42 is made of a wound coil and magnetic fluxes generated as a result of an electric current flowing through the coil are applied to the fixing roller 60, the fixing roller 60 being thus heated according to the induction heating principle. A counter 45 shown in FIG. 4B is used for counting how many times the carriage 32 performs a go-and-return fixing operation (which will be described later).

A temperature measured through the thermistor 61 is transferred to a heating control means 62 which drives the induction coil 42 based on the transferred temperature so that the temperature may approximate to a set temperature.

Figure 6:
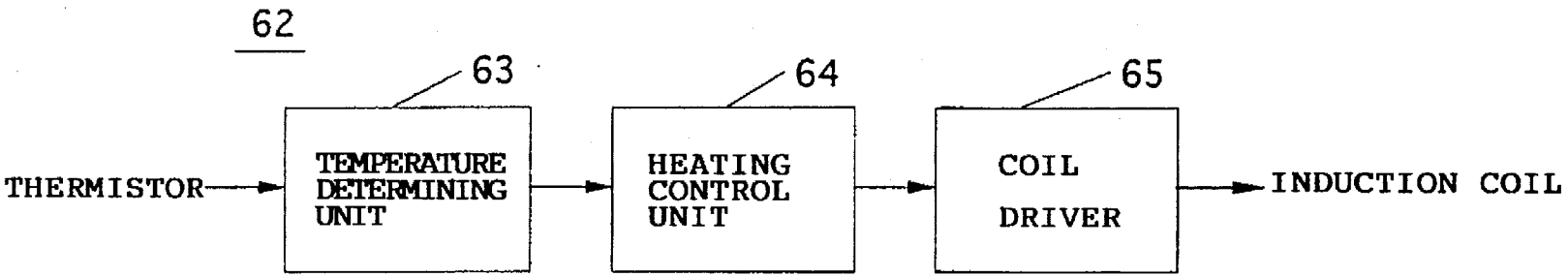
FIG. 6 shows a block diagram of a heating control means shown in FIG. 4A.

With reference to FIG. 6, an operation of the heating control means 62 shown in FIGS. 4B and 5 will now be described. The measured temperature is transferred from the thermistor 61 to a temperature determining unit 63 in which the set temperature is previously set as will be described later. The temperature determining unit 63 compares the measured temperature with the set temperature and outputs a result of the comparison to a heating control unit 64.

The heating control unit 64 produces a control signal based on the comparison result output by the temperature determining unit 63, and outputs it to a coil driver 65. The coil driver drives the induction coil 42 according to the control signal.

Figure 7:
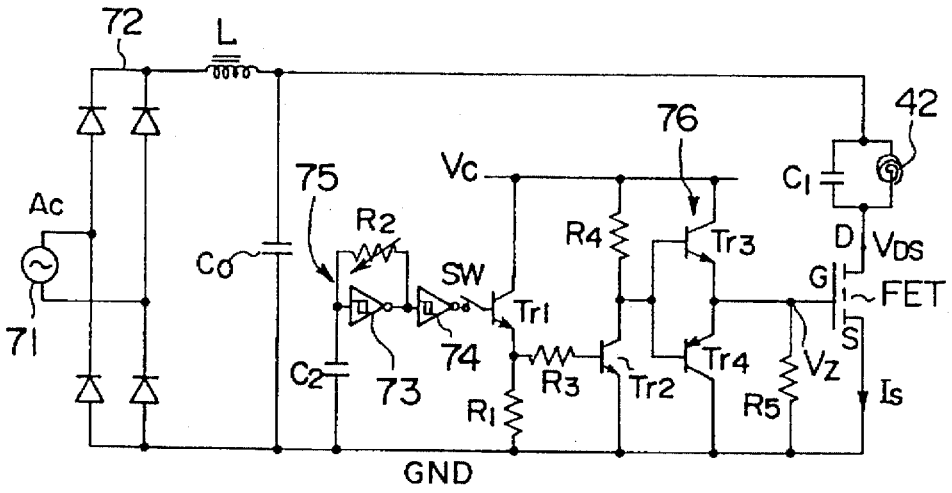
FIG. 7 shows a circuit diagram of an induction coil driving circuit used in the heating control means.

With reference to FIG. 7, a circuit for driving the induction coil 42 in the coil driver 65 will now be described.

As shown in FIG. 7, a rectifying circuit includes an AC power source 71, a full-wave rectifying circuit 72, a smoothing coil L, and a smoothing capacitor Co. The rectifying circuit, a parallel circuit of the induction coil 42 and a capacitor $C_1$, and an FET (Field-Effect Transistor) constitute a closed circuit as shown in the figure.

A serial circuit of an NPN transistor $Tr_1$ and a resistor $R_1$ is connected between a power source Vc and the ground GND. A base of the transistor $Tr_1$ is biased through two Schmitt trigger inverters 73, 74 via a switch SW. A capacitor $C_2$ is connected between an input terminal of the Schmitt trigger inverter 73 and the ground GND, and a variable register $R_2$ is connected between the input terminal and an output terminal of the Schmitt trigger inverter 73. Thus, an oscillating circuit 75 is made from the inverter 73, variable resister $R_2$ and capacitor $C_2$, and an oscillation signal (driving pulses) is input to the base of the transistor $Tr_1$ via the inverter 74 and switch SW. The oscillating circuit 75, inverter 74 and switch SW are externally connected.

The SW is used for supplying an electric current to the induction coil 42.

An emitter follower circuit is made as a result of an emitter of the transistor $Tr_1$ being connected to a base of an NPN transistor $Tr_2$ via a resistor $R_3$. A collector of the transistor $Tr_2$ is connected to the power source Vc via a resistor $R_4$ and is connected to bases of an NPN transistor $Tr_3$ and an PNP transistor $Tr_4$ which transistors are used as an inverter 76. An output of the inverter 76 is connected to a gate G of the FET. The gate G of the FET is connected to the ground GND via a resister $R_5$.

Figure 8A:
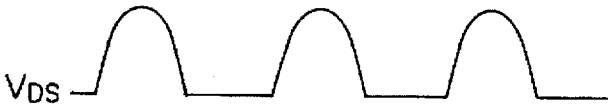
FIGS. 8A, 8B and 8C show waveforms at portions in the circuit shown in FIG. 7.
Figure 8B:
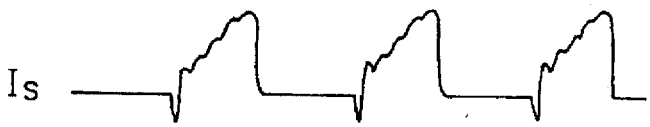
Figure 8C:
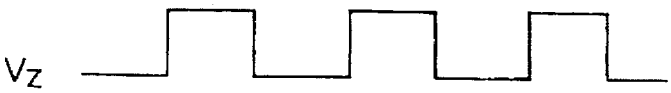

Waveforms of an electric potential Vz of a drain D of the FET, an electric current Is flowing through the FET, and an electric potential $V_{DS}$ of the gate G of the FET are shown in FIGS. 8A, 8B and 8C, respectively.

In such a driving circuit, the FET is turned on/off via the inverter 76 by the driving pulses supplied via the switch SW. As a result, a resonance (a resonance frequency being 20 kHz through 40 kHz when the fixing roller 60 is made of iron) is caused by an inductance component of the induction coil 42 and a capacitance component of the capacitor $C_1$. A resulting variation in the electric current Is flowing through the induction coil 42 results in application of a variation in magnetic fluxes to the fixing roller 60. As a result, eddy currents occur in the fixing roller 60 and thus heat is generated as a result of the eddy currents flowing through a resistance component of the fixing roller 60.

Figure 9A:
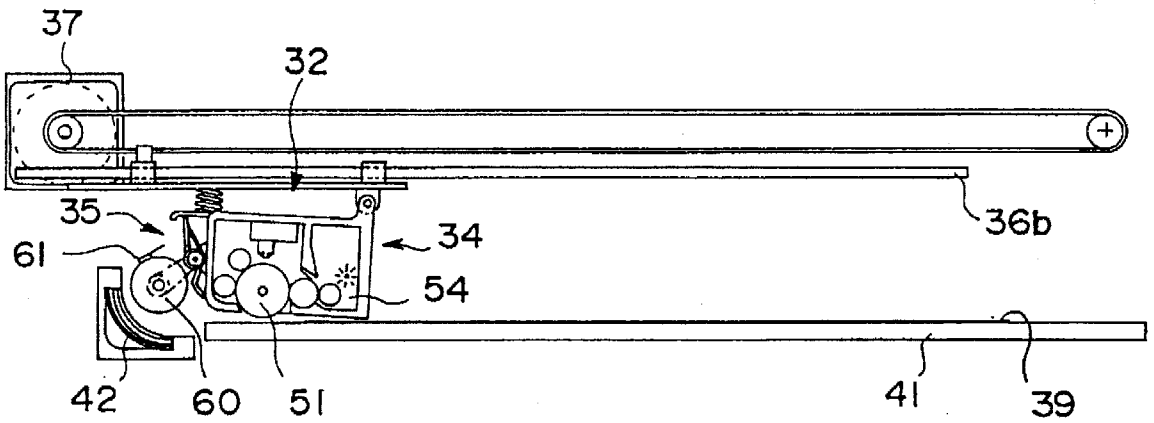
FIGS. 9A and 9B show a view, similar to that shown in FIG. 4B, for illustrating operations of the printer.
Figure 9B:
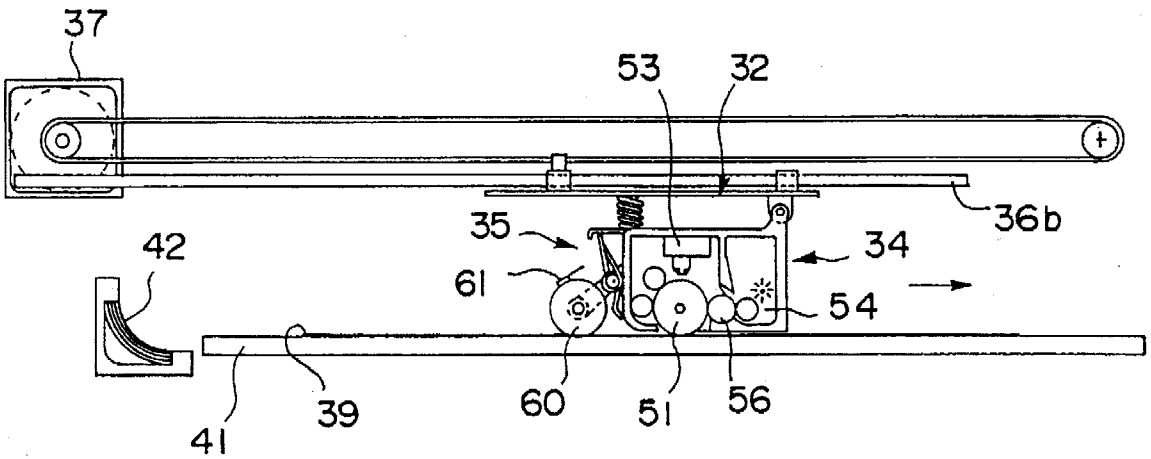

With reference to FIGS. 9A and 9B, the printing operation of the first embodiment will now be described. When the carriage 32 is at the home position as shown in FIG. 9A, the fixing roller 60 is located in proximity to the induction coil 42. At this time, an electric current is supplied to the induction coil 42 and the fixing roller 60 is heated according to the induction heating principle.

The fixing roller 60 reaches a predetermined temperature, the carriage 32 moves on the recording sheet 39, and performs the image transfer and fixing of the image, as show in FIG. 9B. Then after the image transfer and fixing of the image for one line has been finished, the carriage 32 is returned from the printing finishing position to the home position in a state in which each of the recording drum 51 and fixing roller 60 is spaced away from the recording sheet 39 as a result of lifting the carriage 32. Thus, the carriage 32 performs the go-and-return fixing operation. Then, the recording sheet 39 is conveyed a predetermined length, and then a subsequent line of the printing operation (image transfer and fixing the image) is performed. This cycle is repeated for a predetermined number of times.

Then, either after the cycle has been repeated for the predetermined number of times or after the temperature of the fixing roller 60 has dropped to a temperature at which an appropriate fixing cannot be performed (as will be described below), the carriage 32 is returned to the home position, and the fixing roller 60 is heated by the induction coil 42 an appropriate amount.

The temperature control of the fixing roller 60 will now be described. As mentioned above, the fixing of the toner image transferred to the recording sheet 39 can be appropriately performed at a fixing roller 60 temperature range between 180° C. through 210° C. In other cases, an appropriate fixing may not be performed. That is, 180° C. is the lowest allowable fixing temperature of the surface of the fixing roller 60 required for performing an appropriate fixing. Further, 210° C. is an initial set temperature (a second set temperature) to which the fixing roller 60 is heated before starting the printing.

In this embodiment, for example, two fixing rollers 60 are prepared. The first fixing roller 60 is made of stainless steel (SUS430, volume density: 7820 kg/mm$^3$) and has a hollow cylindrical shape having a wall thickness of 1 mm. Further, an outer diameter is 24 mm, an inner diameter is 22 mm, and a length is 28 mm. This first fixing roller has a weight of 0.0158 kg and a heat capacity of 1.7 cal/°C.

The second fixing roller 60 is made of stainless steel (SUS430) and has a solid cylindrical shape having a diameter of 28 mm and a length of 28 mm. This has a weight of 0.099 kg and a heat capacity of 10.9 cal/° C. Therefore, a temperature drop rate of the second fixing roller 60 is smaller than that of the first fixing roller 60.

The heat capacity of each of the first and second fixing rollers 60 is determined such that the temperature of the fixing roller 60 which has been heated to the initial heating temperature does not drop to a temperature less than the lowest allowable fixing temperature as the carriage 32 performs once the go-and-return fixing operation.

Figure 10A:
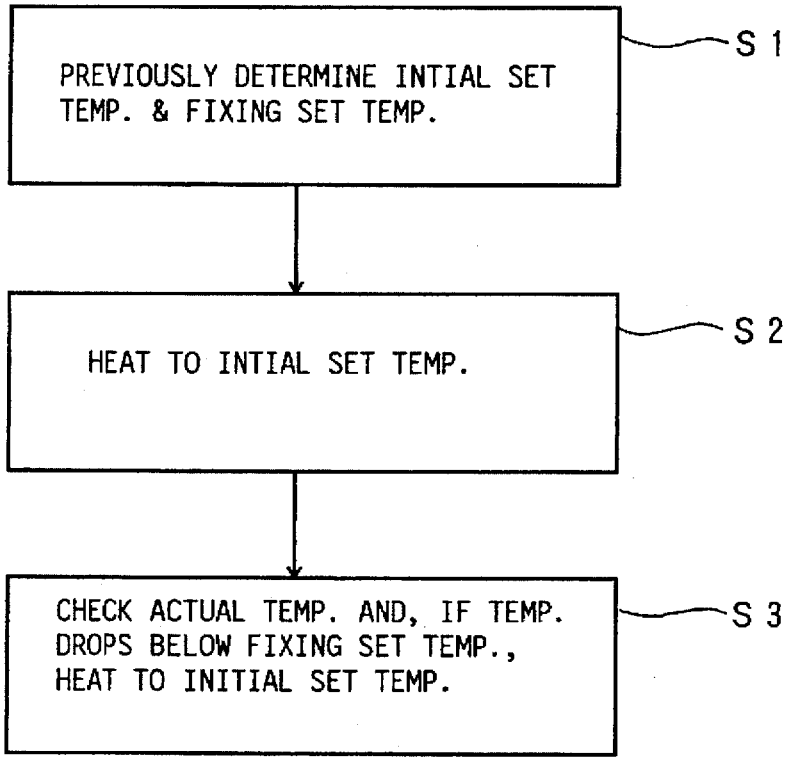
FIGS. 10A, 10B show flowcharts in a fixing roller heating control method for the printer shown in FIG. 4A.
Figure 11A:
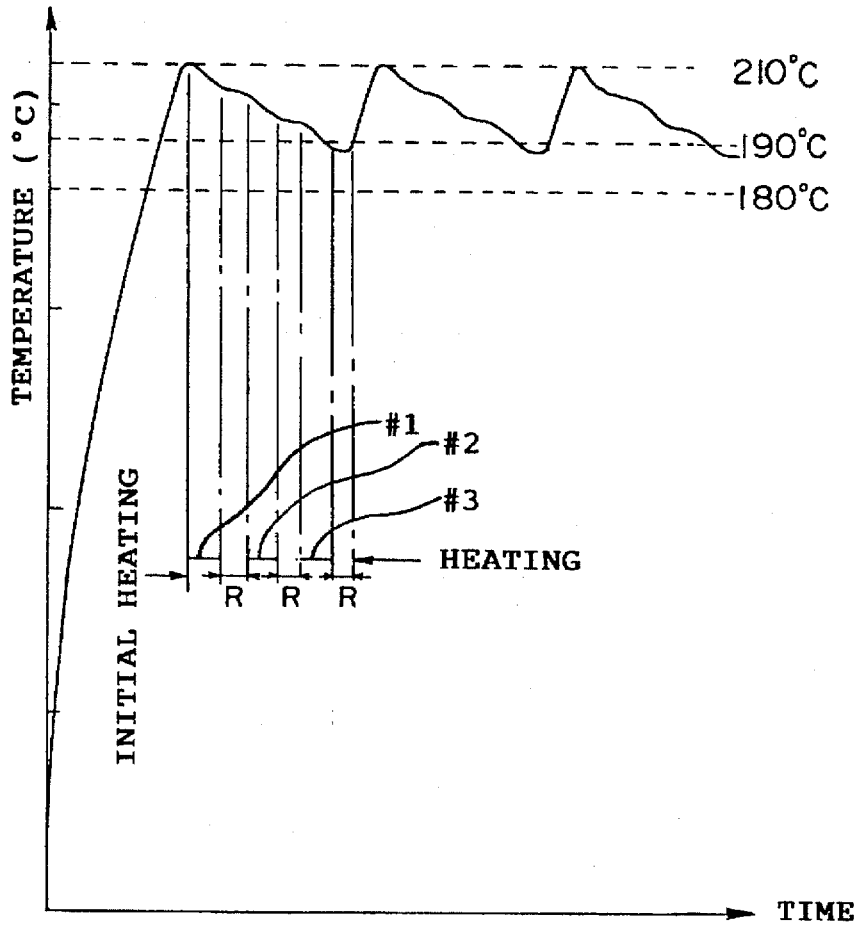
FIGS. 11A and 11B show graphs of fixing roller temperature variation at the application of the method shown in FIGS. 10A and 10B.

With reference to FIGS. 10A and 11A, the fixing roller temperature control will now be described. If the above-mentioned first fixing roller 60 having the above-mentioned heat capacity is used as the fixing roller 60 in the embodiment, a temperature drop of the fixing roller 60 at a normal ambient temperature is 8° C. when the carriage 32 performs once the go-and-return fixing operation. An initial set temperature (the second set temperature) and a fixing set temperature (a first set temperature) are determined in a step S1 (the term 'step' to be omitted, hereinafter) shown in FIG. 10A.

First, the heat capacity of the fixing roller 60 is such that, if the fixing roller 60 is previously heated to the initial set temperature, the above-mentioned temperature drop (8° C. as mentioned above) of the fixing roller 60 resulting from a single the go-and-return fixing operation of the carriage 32 does not result in the temperature of the fixing roller 60 dropping below the lowest allowable fixing temperature (180° C. in this case). The initial set temperature is a temperature such that, as a result of the predetermined number of times of the go-and-return fixing operation of the carriage 32 being performed, the temperature of the fixing roller 60 becomes the lowest allowable fixing temperature (180° C. in this case). The initial set temperature is the maximum allowable temperature and is 210° C. (the second set temperature) in this case.

The fixing set temperature (190° C. in this case) is a temperature such that if a temperature of the fixing roller 60 is above the fixing set temperature and then the go-and-return fixing operation of the carriage 32 is performed once, a resulting temperature drop of the fixing roller 60 does not result in a temperature of the fixing roller dropping below the lowest allowable fixing temperature (180° C. in this case).

Before starting the printing operation, the carriage 32 is located in the home position (retreating portion) and the fixing roller 60 is heated to the initial set temperature of 210° C. as a result of the induction coil 42 being driven, in S2. The thermistor 61 is used to measure the temperature of the fixing roller 60.

Then, the carriage 32 performs the first line of printing and the fixing roller 60 performs the fixing operation. Then, the temperature of the fixing roller 60 drops as shown in FIG. 11A by '#1'. As the carriage 32 is returned to the home position the temperature further drops as shown in the figure by the subsequent 'R'. Thus, after the go-and-return fixing operation is performed once, the temperature of the fixing roller 60 is 202° C. The temperature determining unit 63 determines that the temperature is higher than the fixing set temperature 190° C., in S3.

Therefore, the carriage 32 performs the second line of printing and the fixing roller 60 performs the fixing operation. Then, the temperature of the fixing roller 60 drops as shown in FIG. 11A by '#2'. As the carriage 32 is returned to the home position, the temperature further drops as shown in the figure by the subsequent 'R'. Thus, the go-and-return fixing operation is performed once more. As a result, the temperature of the fixing roller 60 is 194° C. The temperature determining unit 63 again determines that the temperature is higher than the fixing set temperature 190° C., in S3.

Therefore, the carriage 32 performs the third line of printing and the fixing roller 60 performs the fixing operation. Then, the temperature of the fixing roller 60 drops as shown in FIG. 11A by '#3'. As the carriage 32 is returned to the home position, the temperature further drops as shown in the figure by the subsequent 'R'. Thus, the go-and-return fixing operation is performed once again. As a result, the temperature of the fixing roller 60 is 186° C. The temperature determining unit 63 this time determines that the temperature is lower than the fixing set temperature 190° C., in S3.

The induction coil 42 is driven and thus the fixing roller 60 is heated to the initial set temperature 210° C., in S3, after the carriage 32 has been returned to the home position.

Thus, because the third line of printing is performed after determining that the current temperature 194° C. is higher than the fixing set temperature 190° C., the temperature of the fixing roller 60 does not drop below the lowest allowable fixing temperature 180° C.

Thus, an effective temperature control can be achieved. Specifically, a number of times of the fixing roller heating operation can be advantageously reduced although a temperature of the fixing roller can be prevented from dropping below the lowest allowable fixing temperature during the fixing operation. Thus, degradation of a printing quality can be effectively prevented.

There may be a case where a cooling rate of the fixing roller 60 is raised due to a change in an environment of the printer. As a result, a cooling rate (the above-mentioned 8° C.) for single the go-and-return fixing operation of the carriage 32 may be raised. Thus, although the measured temperature at the end of the second line of the printing operation is higher than the fixing set temperature 190° C., the temperature of the fixing roller 60 may drop below the lowest allowable fixing temperature 180° C. during the third line of the printing operation. Thus, an appropriate printing may not be performed and a printing quality may be degraded.

Figure 10B:
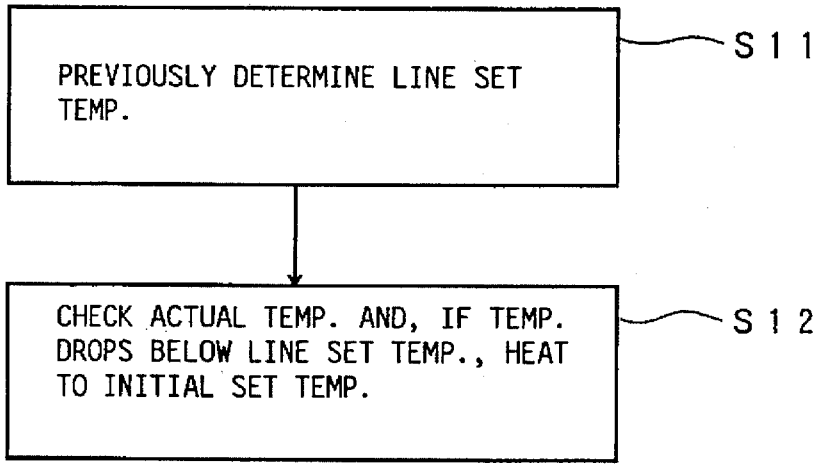
Figure 11B:
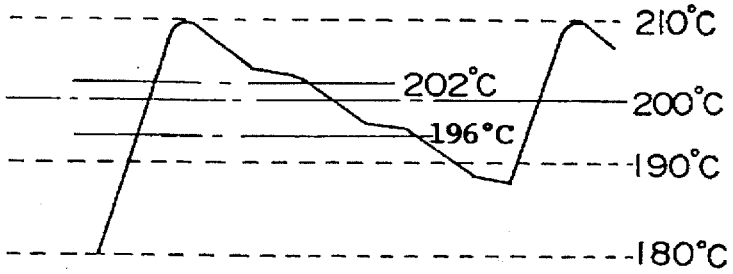

In order to prevent such a situation from occurring, line set temperatures are preset for particular ones of the lines of printing operations, that is, preset for particular go-and-return fixing operations after the temperature of the fixing roller 60 has been heated to the initial set temperature 210° C., as shown in S11 of FIG. 10B. For example, as shown in FIG. 11B, the line set temperature for the end of the first line of the printing operation is preset to be 202° C., and the line set temperature for the end of the second line of the printing operation is preset to be 196° C.

Then, if an actually measured temperature of the fixing roller 60 at the end of the first line of the go-and-return fixing operation is higher than the line set temperature 202° C. in determination in S12, the second line of the go-and-return fixing operation is started. If it is lower than 202° C. in S12, the induction coil 42 is driven and thus the fixing roller 60 is heated to the initial set temperature 210° C., in S12, after the carriage 32 has been returned to the home position.

A similar operation using the above line set temperature 196° C. is performed at the end of the second line of the go-and-return fixing operation if it is performed. Then, if the third line or more of the go-and-return fixing operation is performed according to the determination in S12, the above-mentioned fixing set temperature 190° C. is used as a threshold temperature in S12. If the temperature of the fixing roller 60 is higher than 190° C., the subsequent line of the go-and-return fixing operation is performed. If the temperature of the fixing roller 60 is lower than 190° C., the fixing roller 60 is heated to the initial set temperature 210° C.

Thus, a finer temperature control can be achieved and thus an unexpectable environmental change may not result in a temperature of the fixing roller dropping below the lowest allowable fixing temperature during the fixing operation. Thus, degradation of a printing quality can be effectively prevented.

Figure 12:
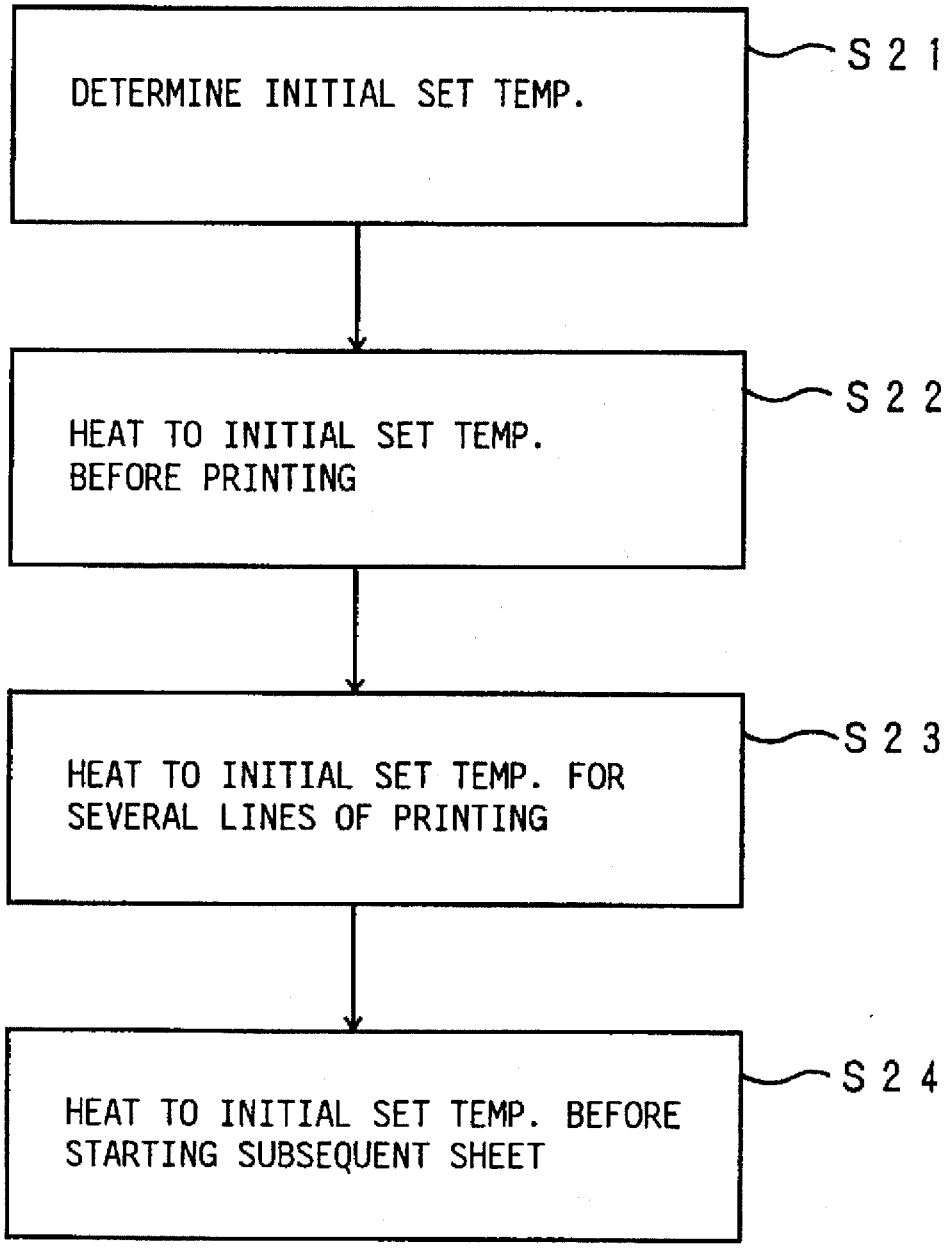
FIG. 12 shows a flowchart in a fixing roller heating control method for the printer shown in FIG. 4A.
Figure 13:
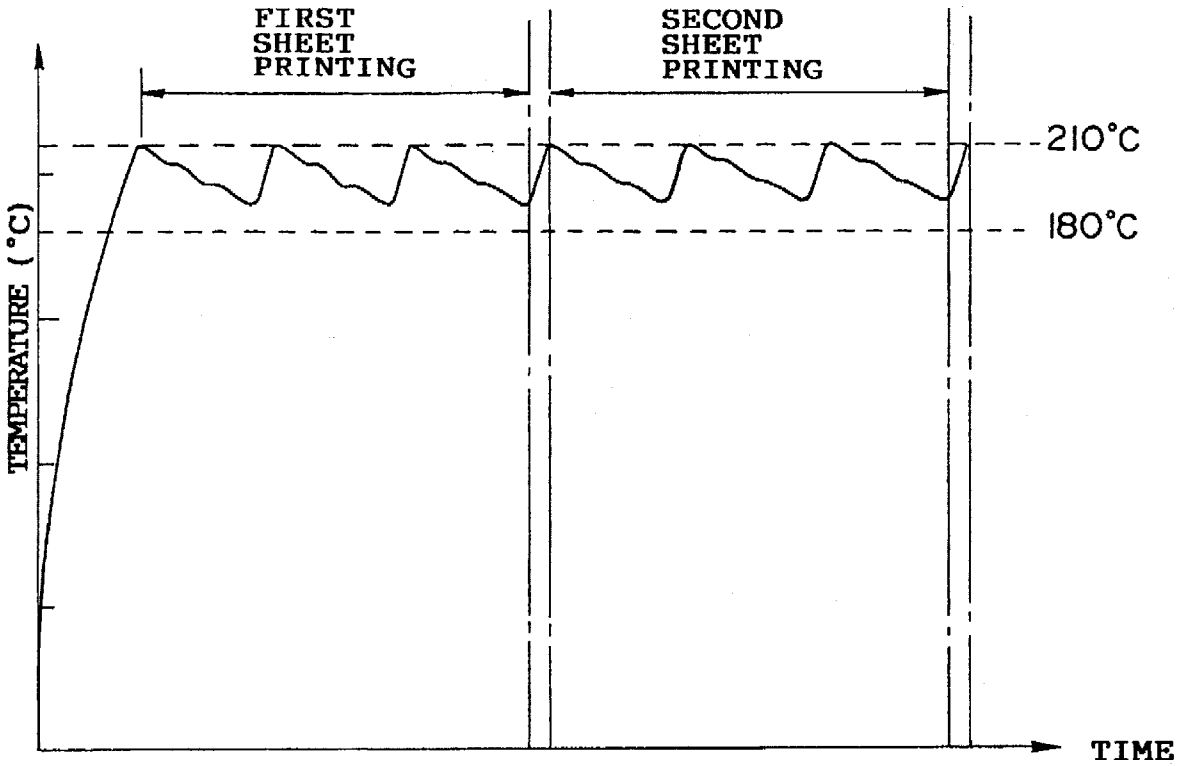
FIG. 13 shows a graph of fixing roller temperature variation at the application of the method shown in FIG. 12.

With reference to FIGS. 12 and 13, another method of the fixing roller heating control performed by the heating control means will now be described. Basically, the method is the same as the method described above with reference to FIGS. 10A, 10B, 11A, 11B. However, the initial set temperature is determined in S21 of FIG. 12 in a manner which will now be described.

By using the initial set temperature, the temperature of the fixing roller 60 becomes the lowest allowable fixing temperature 180° C. at the time printing of one recording sheet has been finished after repeating the go-and-return fixing operation of the carriage 32, as shown in FIG. 13. During the performing of a predetermined number of times of the go-and-return fixing operation, operations of heating the fixing roller 60 to the initial set temperature are performed appropriately according to the operation sequences described above with reference to FIGS. 10A, 10B, 11A, 11B.

Before starting the printing for one recording sheet, the fixing roller 60 is heated to the initial set temperature in S22 in a state in which the carriage 32 is located at the home position.

Further, during the printing for the recording sheet, the fixing roller 60 is heated to the initial set temperature in S23, in a state in which the carriage 32 is located at the home position, each time the carriage 32 performs a predetermined number of times of the go-and-return fixing operation (thrice in the example shown in FIG. 11A).

For realizing the heating each time the carriage performs the predetermined number of times of the go-and-return fixing operation, counting means is provided in the heating control means 62. The counting means counts a number of times of the go-and-return fixing operation. The fixing roller 60 is heated as mentioned above after the counting means has counted the predetermined number of times from the time the fixing roller 60 was heated previously. Further, for safety, the heating control means 62 monitors the temperature of the fixing roller 60 through the thermistor 61, and performs the fixing roller heating when the condition stated in S3 shown in FIG. 10A or S12 shown in FIG. 10B is fulfilled.

However, it is also possible to omit counting of a number of times of the go-and-return fixing operation for determining the fixing roller heating timing during the printing for one recording sheet. Instead, only the result of the monitoring of the fixing roller temperature through the thermistor may be used for determining the fixing roller heating timing during the printing for one recording sheet.

Then, when the printing of the recording sheet has been finished and thus the last line of the go-and-return fixing operation has been finished, the temperature of the fixing roller 60 is the lowest allowable fixing temperature accordingly. Then, the fixing roller 60 is heated to the initial set temperature in S24 in a state in which the carriage 32 is located at the home position. This fixing roller 60 heating operation together with the operation that the carriage 32 returns to the home position is performed during a time the printer 31 ejects the recording sheet 39 having a printed image thus produced thereon and conveys a subsequent recording sheet 39 to the position between the carriage 32 and transfer device 41 and before the go-and-return fixing operation for the subsequent sheet is started, as shown in FIG. 13.

In this method, the time required for ejecting the printed recording sheet 39 and conveying a subsequent recording sheet 39 is effectively used for performing the fixing roller 60 heating operation. As a result, it is possible to achieve high-speed printing.

There is a case in which data is transferred from a host apparatus to the printer 31 and the transferred data is printed out by the printer 31. In such a case the data is transferred either at the end of printing for one recording sheet or during the printing for the recording sheet. In the latter case, the data may be transferred from the host apparatus each time a predetermined number of lines of printing are performed. During the data transfer, the printing operation may be halted. In such a case, the initial set temperature may be previously determined in a manner which will now be described.

By using the initial set temperature, the temperature of the fixing roller 60 may be the lowest allowable fixing temperature 180° C. at the time the above-mentioned predetermined number of lines have been printed. During the printing of the predetermined number of lines and thus at the same time as the go-and-return fixing operations, the fixing roller 60 heating operations to the initial set temperature may be inserted appropriately according to the operation sequences described above with reference to FIGS. 10A, 10B, 11A, 11B.

Thus, the time when the printing operation is halted for the data transfer can be effectively used for performing the fixing roller 60 heating operation. As a result, it is possible to achieve high-speed printing.

Figure 14:
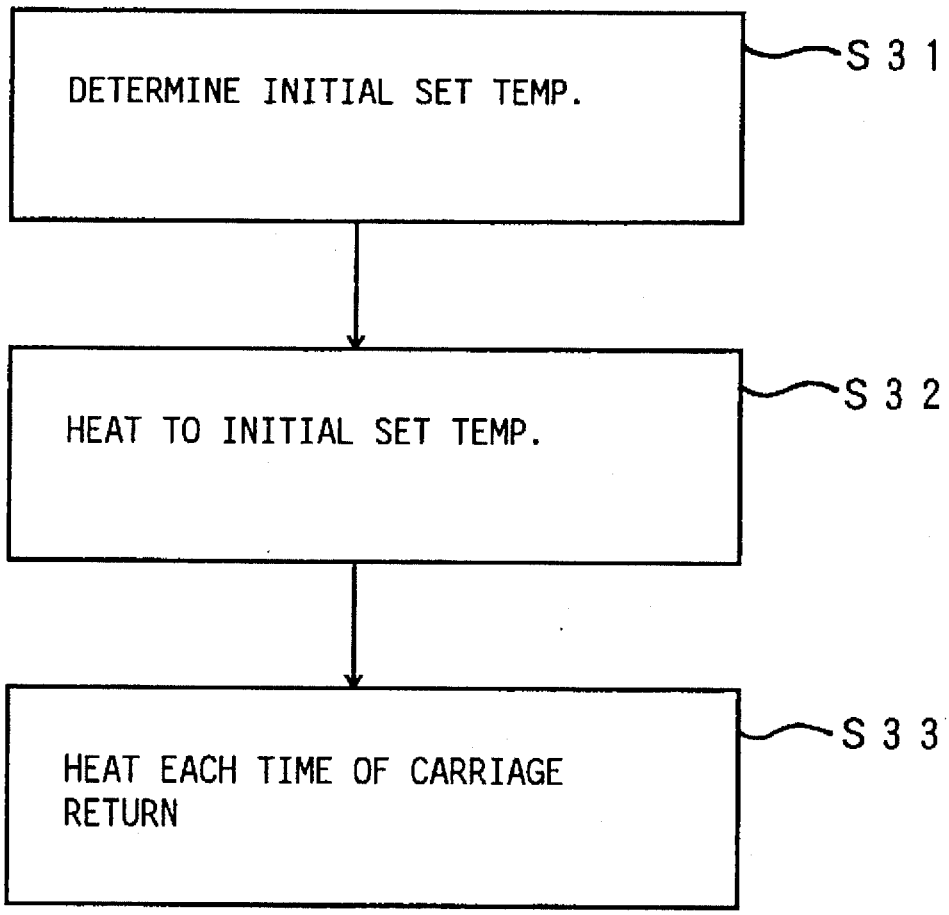
FIG. 14 shows a flowchart in a fixing roller heating control method for the printer shown in FIG. 4A.
Figure 15:
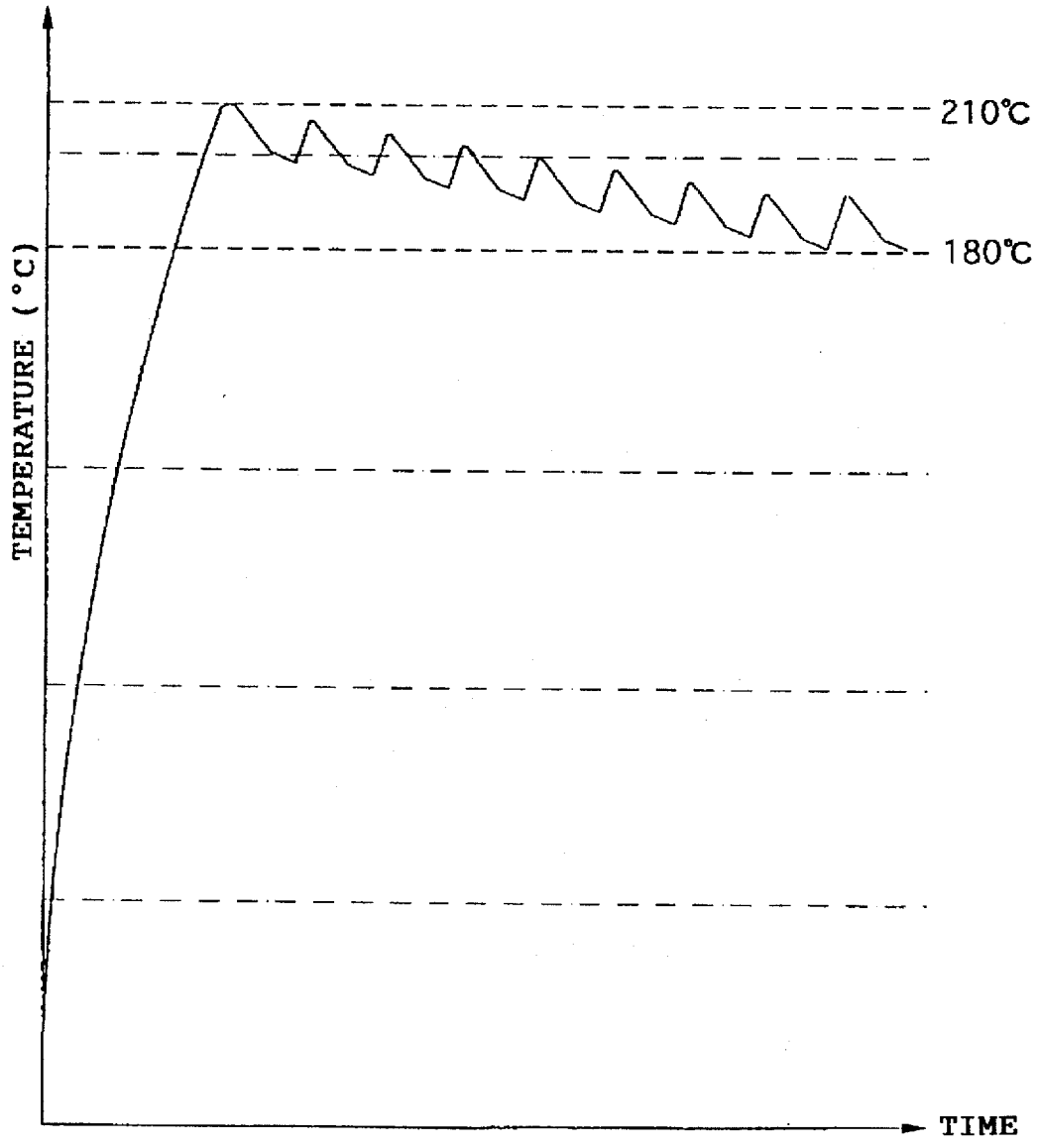
FIG. 15 shows a graph of fixing roller temperature variation at the application of the method shown in FIG. 14.

With reference to FIGS. 14 and 15, another method of the fixing roller heating control will now be described.

In S31 and S32 shown in FIG. 14, similarly to the operations of S1 and S2 shown in FIG. 10A, the initial set temperature is determined, and the fixing roller 60 is heated to the initial set temperature before starting the printing operation. Thus, the initial set temperature is determined such that, after the fixing roller is heated to the initial set temperature, the carriage performs a predetermined number of times of the go-and-return fixing operation, and thus the temperature of the fixing roller becomes the lowest allowable fixing temperature. However, in this method, the fixing roller 60 is heated to a temperature lower than the initial set temperature each time the carriage 32 is returned to the home position during the printing operation, in S33.

As a result, the temperature of the fixing roller 60 varies as shown in FIG. 15. As shown in the figure, a cycle of rising and dropping of the temperature of the fixing roller 60 is repeated. Because an amount of the heating each time the carriage 60 is returned is small, the temperature of the fixing roller 60 generally drops gradually as shown in the figure. If the heating each time the carriage is returned is performed to raise the temperature of the fixing roller 60 by 7° C. in S33 and the temperature drop in each go-and-return fixing operation of the carriage 60 is 8° C. as mentioned above, the balance is the temperature drop of 1° C. for each go-and-return fixing operation. If the heating in S33 is performed to raise the temperature by 6° C., the balance is 2° C. for each go-and-return fixing operation.

In this method, the temperature drop for each go-and-return fixing operation is small. Therefore, it is possible to use the fixing roller having a small heat capacity. Further, it is not necessary to previously heat the fixing roller 60 to a high temperature and thus it is possible to determine the initial set temperature (the second set temperature) to be a low value.

In another method of the fixing roller heating control shown in FIGS. 16 and 17, the operations similar to those described with reference to S31, S32 and S33 shown in FIG. 14 are performed in S41, S42 and S43 shown in FIG. 16.

During the go-and-return fixing operations, the fixing roller 60 is heated each time the carriage 60 is returned to the home position in S43. Further, during the go-and-return fixing operations, the above-mentioned counter 45 shown in FIG. 4B counts a number of times of the go-and-return fixing operation of the carriage 32. A number of times of the go-and-return fixing operation is previously determined for each size (for example, A4 size) of the recording sheet 39. Therefore, among the times of the go-and-return fixing operation of the carriage 60 required for one recording sheet 39, the last time thereof can be determined before it is performed.

Then, the fixing roller 60 is heated to a last set temperature immediately, in S44, before the last time of the go-and-return fixing operation for one recording sheet 39. The last set temperature is a temperature such that, when the fixing roller 60 is heated to the last set temperature and then the last time of the go-and-return fixing operation is performed, the temperature of the fixing roller 60 becomes an allowable fixing temperature. The lowest allowable fixing temperature is previously determined to be 186° C. in this case as shown in FIG. 17. This temperature is higher than the above-mentioned true lowest allowable fixing temperature of 180° C. for safety.

Then, when the printing of the recording sheet has been finished and thus the last line of the go-and-return fixing operation has been finished, the temperature of the fixing roller 60 is the lowest allowable fixing temperature accordingly. Then, the fixing roller 60 is heated to the initial set temperature in S45 in a state in which the carriage 32 is located at the home position. This fixing roller 60 heating operation together with the operation that the carriage 32 returns to the home position is performed during a time the printer 31 ejects the recording sheet 39 having the printing thus performed thereon and conveys a subsequent recording sheet 39 to the position between the carriage 32 and transfer device 41 and before the go-and-return fixing operation for the subsequent sheet is started, as shown in FIG. 17.

In this method, the time required for ejecting the printed recording sheet 39 and conveying a subsequent recording sheet 39 is effectively used for performing the fixing roller 60 heating operation. As a result, it is possible to achieve high-speed printing.

A specific example will now be described. The above-mentioned first fixing roller (the temperature drop being 8° C. resulting from a single go-and-return fixing operation) is used as the fixing roller 60. Further, it is assumed that 5 seconds are required for replacing the recording sheet 39, which comprises ejecting the printed sheet and conveying a subsequent sheet to the position between the carriage 32 and the transfer device 41 before the go-and-return fixing operation for a subsequent sheet is started. The initial set temperature is 210° C. and the lowest allowable fixing temperature is 180° C. Further, a capability of the induction coil 42 to perform the induction heating within a range between 180° C. and 210° C. is 5.3° C./second.

Figure 16:
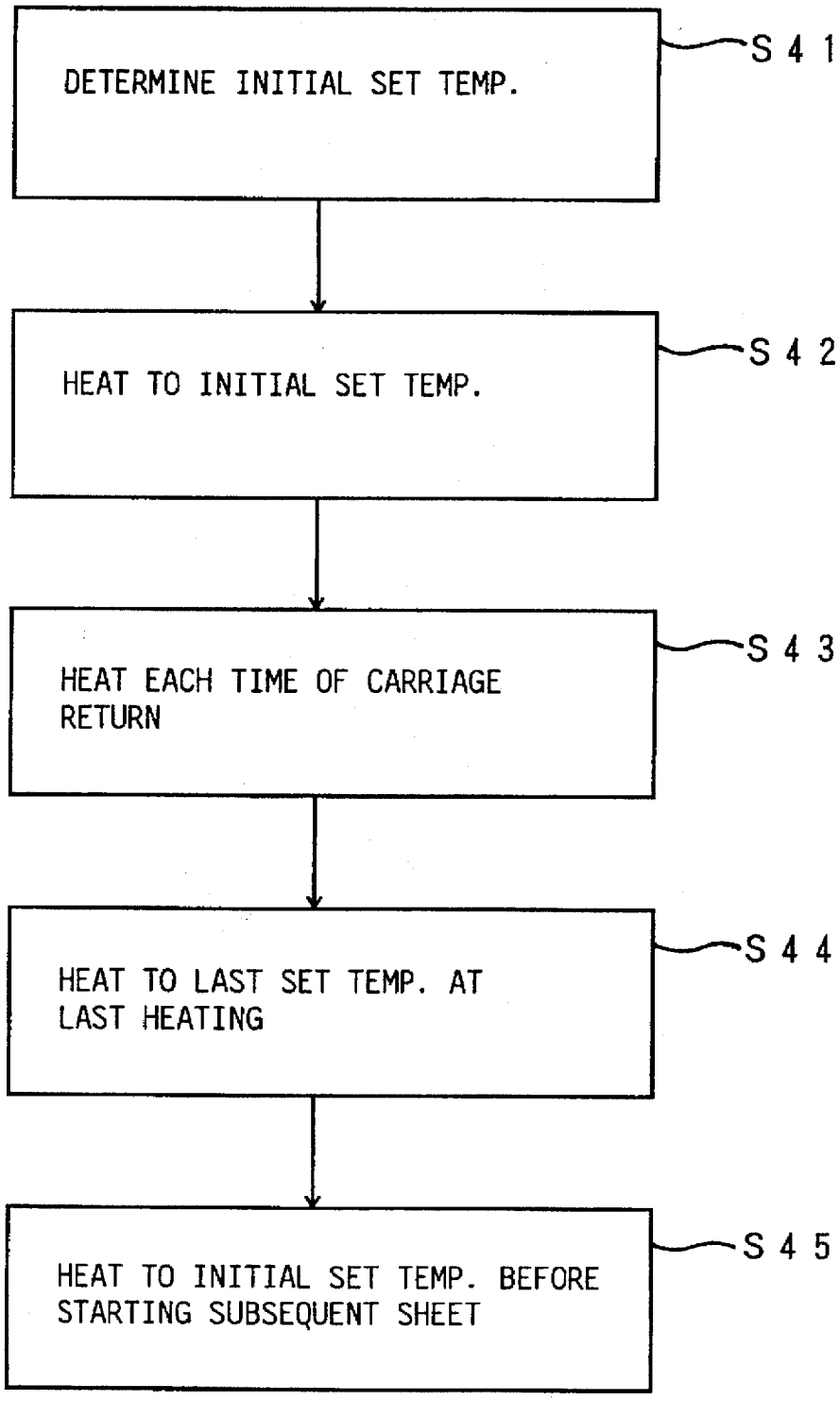
FIG. 16 shows a flowchart an a fixing roller heating control method for the printer shown in FIG. 4A.
Figure 17:
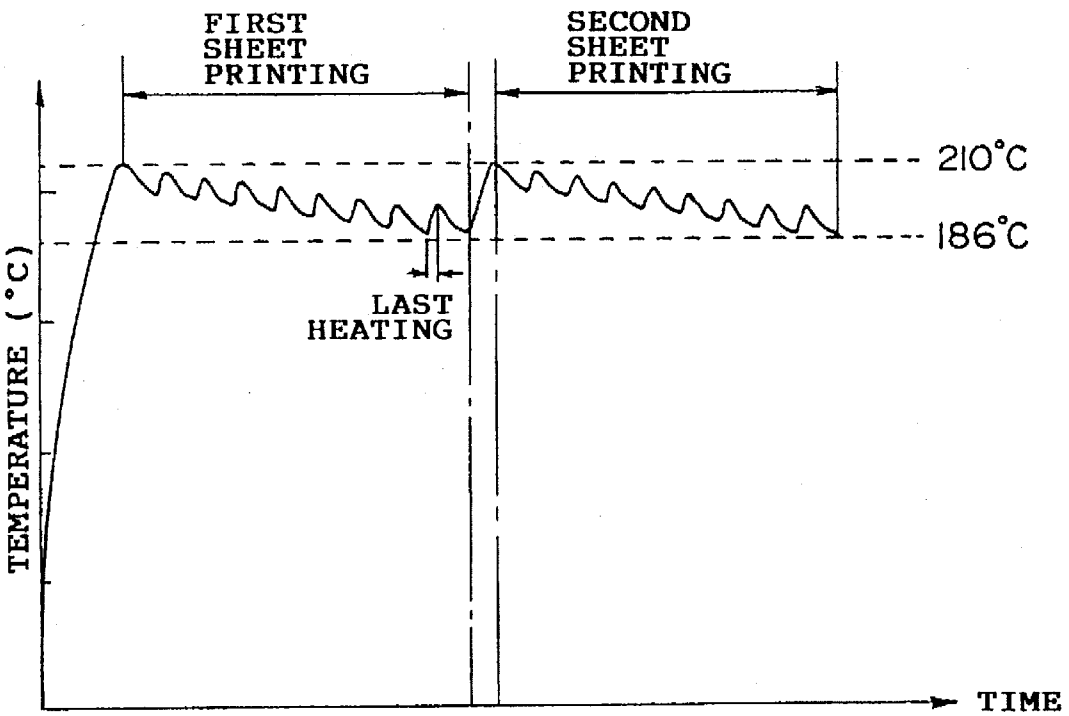
FIG. 17 shows a graph of fixing roller temperature variation at the application of the method shown in FIG. 16.

First, a case in which a method, different from the method described with reference to FIGS. 16 and 17, is used will now be described. In the method, the fixing roller is heated to the initial set temperature 210° C. immediately before the last time of the go-and-return fixing operation for one recording sheet 39. If the temperature of the fixing roller is, for example, 186° C. immediately before the last time of the go-and-return fixing operation for the recording sheet, 4.5 seconds are required for heating the fixing roller to 210° C. Then, when the last time of the go-and-return fixing operation is performed, the temperature of the fixing roller drops 8° C., as mentioned above, to 202° C. Then, during the replacement of the recording sheet, the fixing roller is heated 8° C. from 202° C. to 210° C., 1.5 seconds being required therefor. However, 5 seconds are required for the recording sheet replacement as mentioned above. Therefore, the balance of 3.5 seconds is not used for heating the fixing roller.

Thus, in addition to a time required for the fixing operation itself, 4.5 seconds are required for heating the fixing roller immediately before the last time of the go-and-return fixing operation for the recording sheet and 5 seconds are required for the recording sheet replacement in the method.

In contrast to this, in the method described above with reference to FIGS. 16 and 17, immediately before the last time of the go-and-return fixing operation for the recording sheet, the fixing roller is heated not to the initial set temperature but to the above-mentioned last set temperature in S44. As a result, as described above, the temperature of the fixing roller 60 becomes 186° C. as shown in FIG. 17 when the last time of the go-and-return fixing operation is performed. Then, during the recording sheet replacement, the fixing roller is heated 24° C. from 186° C. to 210° C., 4.5 seconds being required therefor.

Because 5 seconds are required for the recording sheet replacement, the balance of only 0.5 seconds is not used for the heating operation. A time required for the heating operation performed immediately before the last time of the go-and-return fixing operation for the recording sheet is substantially shorter than 4.5 seconds because the last set temperature is lower than the initial set temperature as shown in FIG. 17. Thus, high-speed printing can be achieved as a result of effectively using the recording sheet replacement time.

Figure 18:
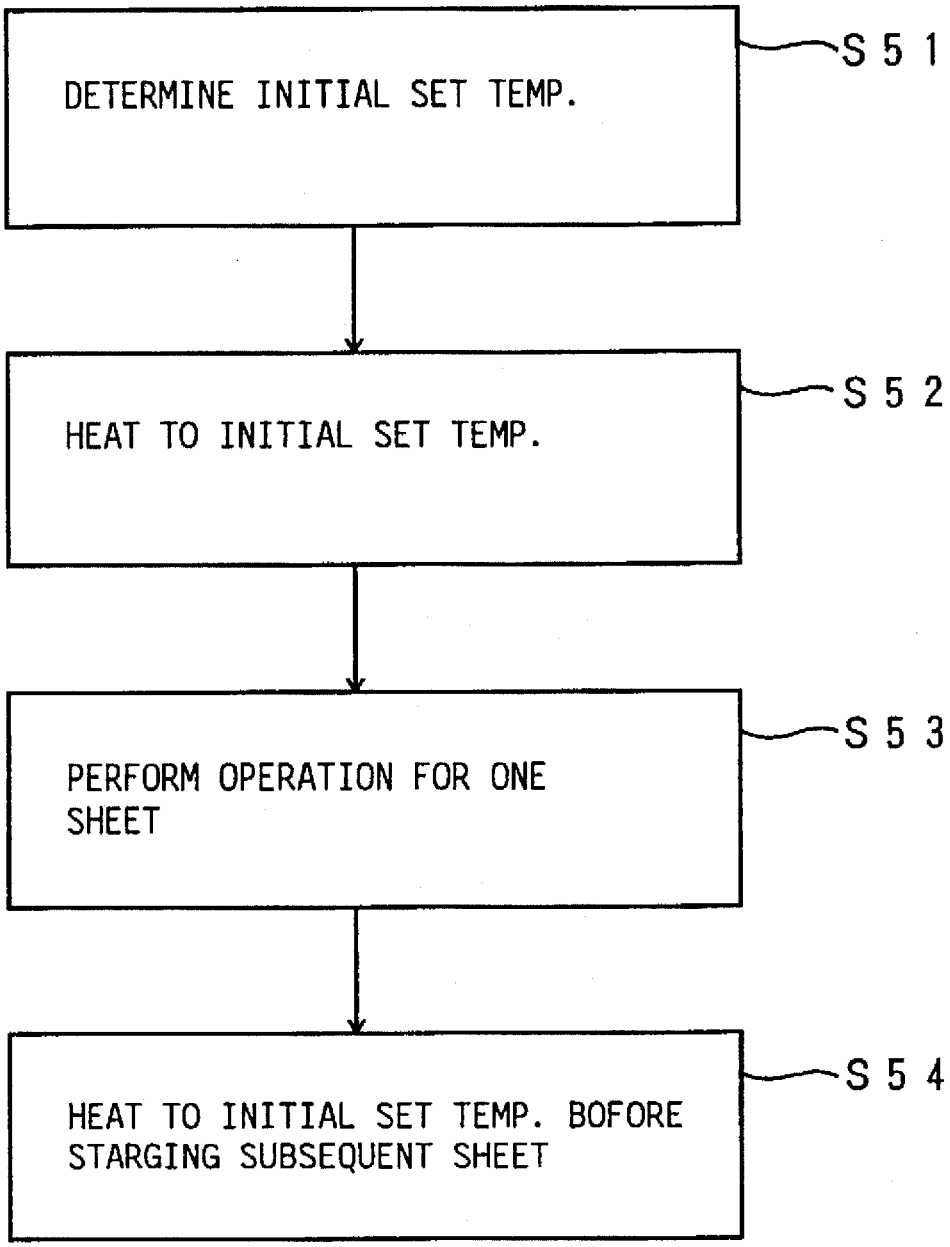
FIG. 18 shows a flowchart in a fixing roller heating control method for the printer shown in FIG. 4A.

Another method of the fixing roller heating control will now be described with reference to FIGS. 18 and 19. In this method, the above-mentioned second fixing roller having the larger heat capacity is used as the fixing roller 60. In S51, the initial set temperature is previously determined such that when the fixing roller 60 is heated to the initial set temperature and then the go-and-return fixing operation of the carriage 32 is repeated so as to perform the printing for one recording sheet the temperature of the fixing roller 60 becomes the lowest allowable fixing temperature (186° C.).

In S52, the fixing roller 60 is heated to the initial set temperature, before starting the printing for the recording sheet, in a state in which the fixing roller 60 is at the home position.

In S53, the go-and-return fixing operation of the carriage 32 is repeated so as to perform the printing for the recording sheet without heating the fixing roller 60. As a result, after the last line of the go-and-return fixing operation has been performed, the temperature of the fixing roller 60 is in proximity to the lowest allowable fixing temperature 186° C., accordingly.

Then, the fixing roller 60 is heated to the initial set temperature in S55 in a state in which the carriage 32 is located at the home position. This fixing roller 60 heating operation together with the operation that the carriage 32 returns to the home position is performed during a time the printer 31 ejects the recording sheet 39 having the printing thus performed thereon and conveys a subsequent recording sheet 39 to the position between the carriage 32 and transfer device 41 and before the go-and-return fixing operation for the subsequent sheet is started, as shown in FIG. 19.

Figure 19:
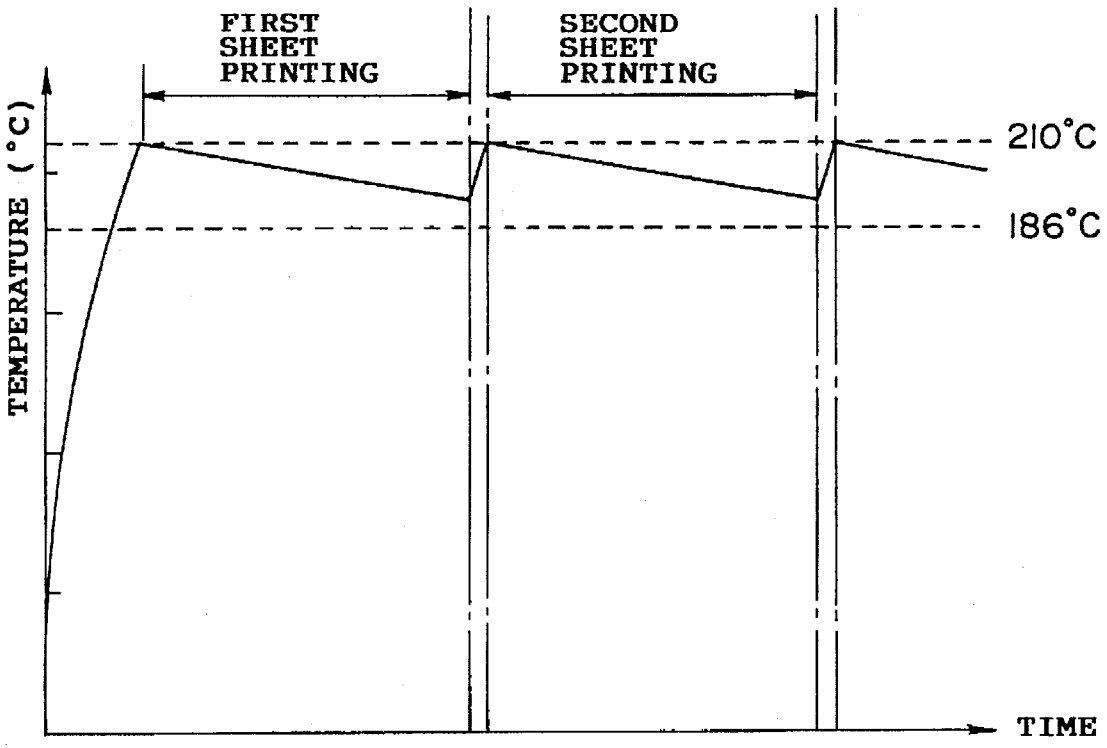
FIG. 19 shows a graph of fixing roller temperature variation at the application of the method shown in FIG. 18.

Then, this operation cycle that the repetition of the go-and-return fixing operation without heating so as to perform the printing for one sheet and heating the fixing roller during the sheet replacement is repeated for each recording sheet, as shown in FIG. 19.

In this method, by eliminating heating operations performed during the printing operation for one sheet, it is possible to improve the printing speed approximately 30% in comparison to the case in which the above-mentioned first fixing roller is used.

In a specific example, if the first fixing roller is used, a time required for the carriage 32 to move over the printing width on the recording sheet 39 is 2.0 seconds, and a time for the carriage 32 to return to the home position is 0.5 seconds. Thus, a total time of 2.5 seconds is required for the go-and-return fixing operation. The temperature drop of the first fixing roller during the go-and-return fixing operation is 8° C.

If an A4-size recording sheet is used, 9 of the go-and-return fixing operations are required to print one sheet. During the printing, it is necessary to heat the fixing roller after each time three of the go-and-return fixing operations have been performed. As a result, to print one sheet, a total of 2 of the heating operations are required, each heating operation requiring 5.4 seconds. As a result, a time required for printing one sheet is obtained from the following equation:

$$(2.5)\cdot 9+(5.4)\cdot 2=33.3 \text{ (seconds)}.$$

If the second fixing roller is used, a time required for one go-and-return fixing operation is the same as that in the above-described case. However, a temperature drop of the fixing roller for one go-and-return fixing operation is 1.3° C. As a result, a time required for printing one sheet is obtained from the following equation:

$$(2.5)\cdot 9=22.5 \text{ (seconds)}.$$

Thus, a balance of 10.8 seconds (approximately 33%) is obtained and, as a result, high-speed printing can be achieved.

Figure 20A:
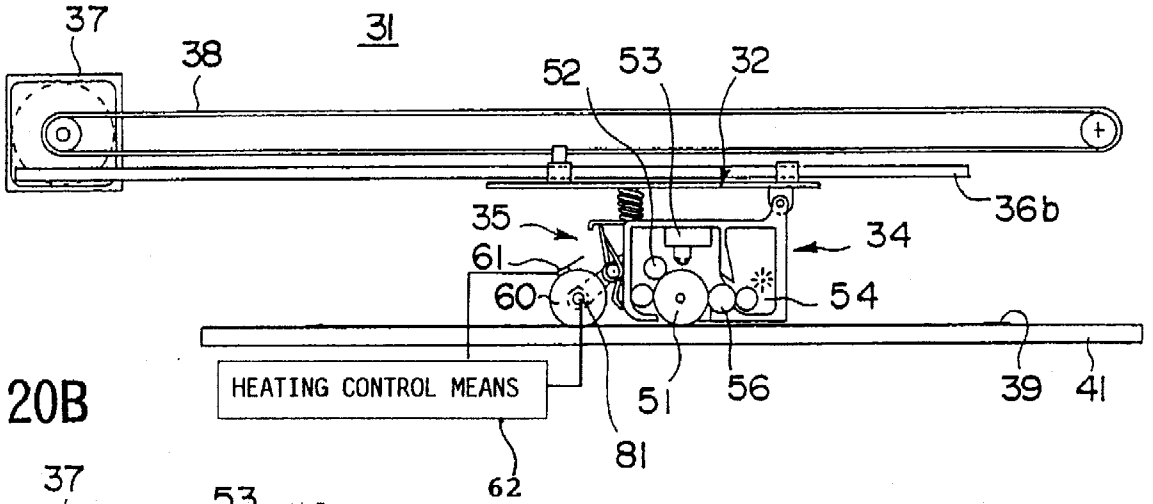
FIGS. 20A and 20B show elevational sectional views of a serial electrophotographic printer in a second embodiment of the present invention.
Figure 20B:
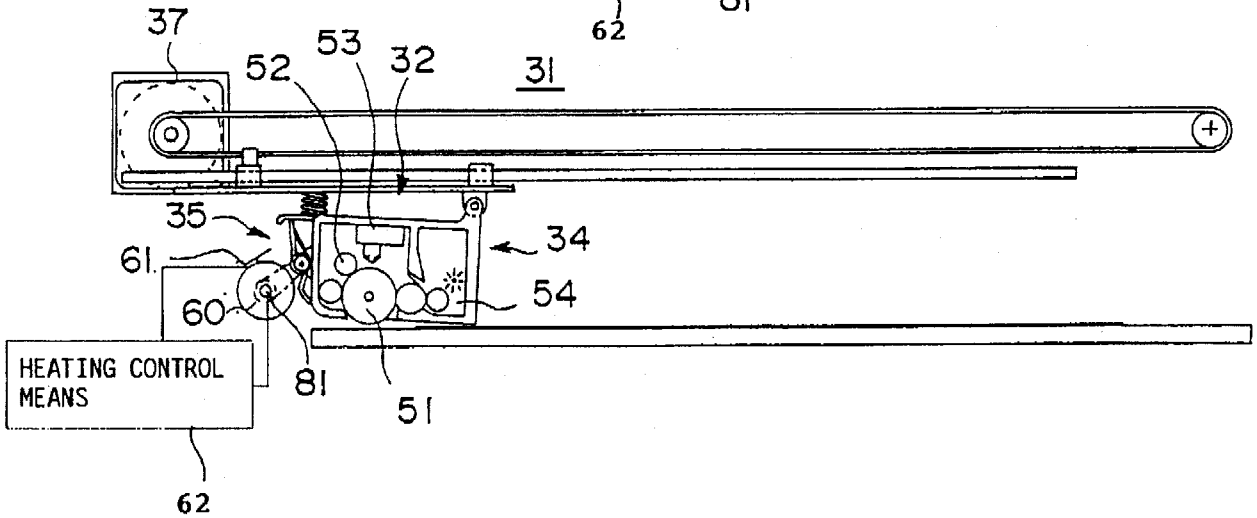
Figure 21:
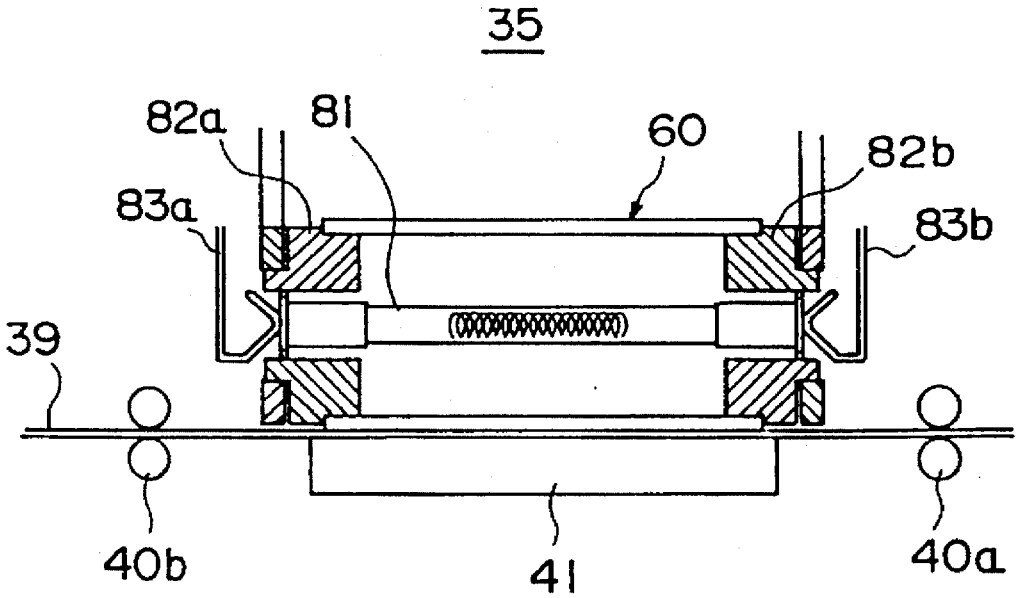
FIG. 21 shows a longitudinal sectional view of a fixing roller shown in FIGS. 20A and 20B.

With reference to FIGS. 20A, 20B and 21, a serial electrophotography printer 31 in a second embodiment of the present invention will now be described.

In the second embodiment, instead of the induction coil 42 for heating the fixing roller 60, a halogen lamp 81 is provided in the hollow fixing roller 60 (the above-described first fixing roller) as the heating means. Except for this arrangement, the structure of the printer 31 in the second embodiment is similar to that described above with reference to FIGS. 4A, 4B, 5, 6, 7, 8A, 8B, and 8C. Further, the printing operation method is similar to that described above with reference to FIGS. 9A and 9B.

As shown in FIG. 21, the fixing roller 60 provided in the fixing portion 35 contains the halogen lamp 81 as a heat source, the lamp 81 extending between flanges 82*a* and 82*b* provided at the two ends of the roller 60. Each of two electric terminals 83*a* and 83*b* for electric power supply is pressed onto and thus electrically comes into contact with a respective two ends of the lamp 81 as shown in the figure.

The heating control means 62 shown in FIGS. 20A and 20B turns on/off the lamp 81 appropriately based on the temperature of the fixing roller 60 measured by the thermistor 61 shown in FIGS. 20A and 20B. Thus, the fixing roller heating control is performed by any of methods described above with reference to FIGS. 10A, 10B, 11A, 11B, 12, 13, 14, 15, 16, and 17.

Although the lamp 81 is provided in the fixing roller 60 for safety to prevent a situation in which, for example, unexpectable excessive temperature rise of the fixing roller 60 may damage the recording sheet 39, an actual heating of the fixing roller 60 by the lamp 81 is performed when the carriage 32 is located at the home position. Therefore, the fixing roller heating control is performed by any of methods described above with reference to FIGS. 10A, 10B, 11A, 11B, 12, 13, 14, 15, 16, and 17 as mentioned above.

Thus, in such a printer as that in the second embodiment in which the heat source is included in the fixing roller, control methods the same as those of the first embodiment may be performed. As a result, the same advantages can be obtained in the printer such as that in the second embodiment.

Further, the present invention is not limited to the above-described embodiments, and variations and modifications may be made without departing from the scope of the present invention.

What is claimed is:

1. A serial electrophotography apparatus comprising:

conveying means for conveying a recording sheet;

a carriage comprising process means for forming a latent image and developing it so as to produce a developed image on an image carrier having a rotation axis parallel to a direction along which said conveying means conveys said recording sheet, and fixing means using a fixing member for fixing said developed image to said recording sheet after said developed image has been transferred to said recording sheet; transfer means for transferring said developed image produced on said image carrier to said recording sheet;

moving means for moving said carriage on said transfer means along a direction perpendicular to said direction along which said conveying means conveys said recording sheet, said carriage thus repeating a go-and-return operation in which said carriage fixes a line of said developed image onto said recording sheet while moving and then returns to a predetermined position;

heating means for heating said fixing member to a predetermined temperature;

measuring means for measuring a temperature of said fixing member; and heating control means for driving said heating means so as to make the temperature of said fixing member be said predetermined temperature based on the temperature measured by said measuring means, the driving being performed either when said carriage is located at said predetermined position or while said carriage is returning to said predetermined position after said go-and-return operation has been performed a predetermined number of times.

2. The apparatus according to claim 1, wherein said heating means is provided either at a position to which said fixing member is in proximity when the carriage is located at said predetermined position or inside said fixing means.

3. The apparatus according to claim 1, wherein said moving means moves said carriage so that said carriage is located at said predetermined position during at least one of a time during which while data to be printed out through said apparatus is being transferred to said apparatus externally and a time during which the recording sheet is being replaced.

4. The apparatus according to claim 1, wherein:

said heating control means has a first set temperature for fixing said developed image onto said recording sheet and a second set temperature to which said fixing member is initially heated; and said heating control means drives said heating means when the temperature of said fixing member is in proximity to said first set temperature.

5. The apparatus according to claim 4, wherein said heating control means drives said heating means so as to heat said fixing member to a temperature not higher than said second set temperature each time a predetermined number of times of said go-and-return operation are performed.

6. The apparatus according to claim 5, wherein said heating control means drives said heating means so as to heat said fixing member, before said go-and-return operation for printing the last line for said recording sheet, so that the temperature of said fixing member may decrease to approximate a temperature, which is the lowest temperature required for performing an appropriate fixing operation, from starting to finishing said printing of said last line.

7. The apparatus according to claim 6, wherein said heating control means drives said heating means so as to heat said fixing member while said recording sheet is being replaced.

8. The apparatus according to claim 1, wherein said heating control means drives said heating means so as to heat said fixing member to a temperature such that the temperature of said fixing member may decrease to approximate to a temperature, which is the lowest temperature required for performing an appropriate fixing operation, from starting to finishing printing of one recording sheet by repetition of said go-and-return operation.

9. The apparatus according to claim 8, wherein said heating control means drives said heating means so as to heat said fixing member while said recording sheet is being replaced.

10. A serial electrophotography apparatus comprising:

conveying means for conveying a recording sheet;

a carriage comprising process means for forming a latent image and developing it so as to produce a developed image on an image carrier having a rotation axis parallel to a direction along which said conveying means conveys said recording sheet, and fixing means using a fixing member for fixing said developed image to said recording sheet after said developed image has been transferred to said recording sheet; transfer means for transferring said developed image produced on said image carrier to said recording sheet;

moving means for moving said carriage on said transfer means along a direction perpendicular to said direction along which said conveying means conveys said recording sheet, said carriage thus repeating a go-and-return operation in which said carriage fixes a line of said developed image onto said recording sheet while moving and then returns to a predetermined position;

heating means for heating said fixing member to a predetermined temperature;

measuring means for measuring a temperature of said fixing member;

heating control means for driving said heating means so as to make the temperature of said fixing member be said predetermined temperature based on the temperature measured by said measuring means, the driving being performed either when said carriage is located at said predetermined position or while said carriage is returning to said predetermined position after said go-and-return operation has been performed a predetermined number of times;

said heating control means further has third set temperatures for predetermined numbers of times of said go-and-return operation performed after said heating means heats said fixing member; and said heating control means drives said heating means, when the temperature of said fixing member is below a relevant one of said third set temperatures after a number of said predetermined numbers of times of said go-and-return operation have been performed after said heating means heats said fixing member.

11. A fixing temperature control method for a serial electrophotography apparatus which comprises a carriage comprising process means for forming a latent image and developing it so as to produce a developed image on an image carrier having a rotation axis parallel to a direction along which said conveying means conveys said recording sheet, and fixing means using a fixing member of a predetermined temperature for fixing said developed image to said recording sheet after said developed image has been transferred to said recording sheet;

said carriage being moved on said transfer means along a direction perpendicular to said direction along which said recording sheet is conveyed, said carriage thus repeating a go-and-return operation in which said carriage fixes a line of said developed image onto said recording sheet while moving and then returns to a predetermined position;

said method comprising steps of:

a) determining an initial set temperature such that the temperature of said fixing member initially heated to said initial set temperature may not drop to a lowest allowable temperature, which is the lowest temperature required for performing an appropriate fixing operation, when said go-and-return fixing operation is performed at least once by said carriage;

b) heating said fixing member to said initial set temperature before printing for said recording sheet is started; and c) heating said fixing member to a temperature not higher than said initial set temperature each time a predetermined number of times of said go-and-return operations have been performed by said carriage.

12. The method according to claim 11, wherein said step c) heats said fixing member so that the temperature of said fixing member may become said lowest allowable temperature at a time of finishing printing of one page of said recording sheet.

13. A fixing temperature control method for a serial electrophotography apparatus which comprises a carriage comprising process means for forming a latent image and developing it so as to produce a developed image on an image carrier having a rotation axis parallel to a direction along which said conveying means conveys said recording sheet, and fixing means using a fixing member at a predetermined temperature for fixing said developed image to said recording sheet after said developed image has been transferred to said recording sheet;

said carriage being moved on said transfer means along a direction perpendicular to said direction along which said recording sheet is conveyed, said carriage thus repeating a go-and-return operation in which said carriage fixes a line of said developed image onto said recording sheet while moving and then returns to a predetermined position;

said method comprising steps of:

a) determining an initial set temperature such that the temperature of said fixing member initially heated to said initial set temperature may not drop to a lowest allowable temperature, which is the lowest temperature required for performing an appropriate fixing operation, when said go-and-return fixing operation is repeated by said carriage so as to perform printing for said recording sheet;

b) heating said fixing member to said initial set temperature before printing for said recording sheet is started; and c) heating said fixing member to a said initial set temperature after said go-and-return operation has been performed for the last line for said recording sheet.

* * * * *